US007397185B2

(12) United States Patent
Yonezawa et al.

(10) Patent No.: US 7,397,185 B2
(45) Date of Patent: Jul. 8, 2008

(54) ELECTRON TUBE AND A METHOD FOR MANUFACTURING SAME

(75) Inventors: Yoshihisa Yonezawa, Chiba (JP); Yukio Ogawa, Chiba (JP); Shogo Ishige, Chiba (JP)

(73) Assignee: Futaba Corporation, Chiba (JP)

( * ) Notice: Subject to any disclaimer, the term of this patent is extended or adjusted under 35 U.S.C. 154(b) by 130 days.

(21) Appl. No.: 10/988,512

(22) Filed: Nov. 16, 2004

(65) Prior Publication Data

US 2005/0062415 A1 Mar. 24, 2005

Related U.S. Application Data

(63) Continuation-in-part of application No. 10/051,094, filed on Jan. 22, 2002, now Pat. No. 6,838,822.

(30) Foreign Application Priority Data

Jan. 22, 2001 (JP) ..... 2001-013749
Apr. 16, 2001 (JP) ..... 2001-117534
Jun. 22, 2001 (JP) ..... 2001-190385

(51) Int. Cl.
*H01J 17/24* (2006.01)
*H01J 19/70* (2006.01)
*H01J 61/26* (2006.01)

(52) U.S. Cl. ..... 313/549; 313/547; 313/553; 313/560; 252/181.1

(58) Field of Classification Search ..... 313/553, 313/549, 547, 560; 252/181.1
See application file for complete search history.

(56) References Cited

U.S. PATENT DOCUMENTS 3,762,995 A * 10/1973 Gulbransen et al. ..... 313/548
4,127,790 A * 11/1978 Kuus et al. ..... 313/562
4,721,882 A * 1/1988 Van Daelen ..... 313/481
4,733,124 A * 3/1988 Oguro et al. ..... 313/341
5,525,861 A * 6/1996 Banno et al. ..... 313/495
5,614,785 A * 3/1997 Wallace et al. ..... 313/496
5,619,097 A * 4/1997 Jones ..... 313/495
5,635,795 A * 6/1997 Itoh et al. ..... 313/496
5,656,889 A * 8/1997 Niiyama et al. ..... 313/553
5,689,151 A * 11/1997 Wallace et al. ..... 313/495
5,789,859 A * 8/1998 Watkins et al. ..... 313/495
5,866,978 A * 2/1999 Jones et al. ..... 313/495
5,925,979 A * 7/1999 Azuma et al. ..... 313/495
5,964,630 A * 10/1999 Slusarczuk et al. ..... 445/25
5,977,706 A * 11/1999 Cho et al. ..... 313/553
6,077,046 A * 6/2000 Kennedy et al. ..... 417/48
6,127,777 A * 10/2000 Watkins et al. ..... 313/554
6,147,450 A * 11/2000 Fritz et al. ..... 313/495
6,396,207 B1 * 5/2002 Hasegawa et al. ..... 313/495
6,422,824 B1 * 7/2002 Lee et al. ..... 417/48
6,472,818 B1 * 10/2002 Ikeda et al. ..... 313/558

(Continued)

*Primary Examiner*—Peter Macchiarolo
(74) *Attorney, Agent, or Firm*—Bacon & Thomas, PLLC

(57) ABSTRACT

In a method for manufacturing an electron tube including a front substrate and a back substrate, a wiring and an electrode are formed on the front substrate and/or the back substrate. A component is mounted on the front substrate and/or the back substrate. A ring-less getter is mounted on at least one of the front substrate, the back substrate and the component. A vessel is assembled and sealed so that the front substrate faces the back substrate. A light is irradiated on the ring-less getter from outside of the sealed vessel, thereby activating the ring-less getter.

14 Claims, 22 Drawing Sheets

U.S. PATENT DOCUMENTS 6,541,912 B1 * 4/2003 Fritz et al. ..... 313/553
6,586,878 B1 * 7/2003 Tu ..... 313/549
6,838,822 B2 * 1/2005 Yonezawa et al. ..... 313/562

* cited by examiner

ELECTRON TUBE AND A METHOD FOR MANUFACTURING SAME

CROSS REFERENCE TO RELATED APPLICATION

This application is a continuation-in-part application of U.S. application Ser. No. 10/051,094 filed on Jan. 22, 2002.

FIELD OF THE INVENTION

The present invention relates to an electron tube and a method for manufacturing the same; and, more particularly, to a fluorescent display device having a getter and a method for manufacturing the same.

BACKGROUND OF THE INVENTION

Referring to FIGS. 20 and 21, structure and function of a conventional fluorescent display device having a getter will be described. FIGS. 20 and 21 show cross sectional views of the conventional fluorescent display device, respectively. In FIGS. 20A and 20B, reference numerals 70, 71 and 72 represent a side substrate, a first substrate and a second substrate, respectively, which constitute a vacuum vessel of a fluorescent display device.

Referring to FIG. 20A, a supporting member 74 is fixed to an insulation layer 73 formed on the second substrate 72, wherein a metal vessel 75 having getter material 76 filled therein is attached to the supporting member 74. When a laser beam is irradiated from outside of the second substrate 72 onto a bottom of the metal vessel 75, the getter material 76 is evaporated to thereby form a getter film on the first substrate 71 (e.g., see, Japanese Patent Laid-Open Publication No. 11-260262).

In this case, the metal vessel 75 is usually made of a nickel-plated steel vessel of a ring shape. The getter material 76, e.g., made of Ba, Al or Ni, is filled into the vessel 75. This type of getter is usually called as a ring-shaped getter.

Referring to FIG. 20B, a vessel 77 accommodating ball-shaped getter material 78 therein is installed at an opening part of the first substrate 71. When a selective heating is applied on the getter material 78 by employing a selective heating unit, e.g., a laser unit, the getter material 78 is activated (e.g., see, Japanese Patent Laid-Open Publication No. 10-64457).

In FIGS. 21A and 21B, reference numerals 80, 81 and 82 represent a side substrate, a first substrate and a second substrate, respectively, which constitute a vacuum vessel of a fluorescent display device. Referring to FIG. 21A, powder type getter material 83 is filled in a recessed portion formed in the second substrate 82. When a laser beam is irradiated on the getter material 83 from outside of the second substrate 82, the getter material 83 is evaporated to thereby form a getter film on the first substrate 81 (e.g., see, Japanese Patent Laid-Open Publication No. 5-114373).

Referring to FIG. 21B, a getter material layer 84 is formed on the second substrate 82 by employing, e.g., deposition technique. When a laser beam is irradiated on the getter material layer 84 from outside of the second substrate 82, the getter material layer 84 is evaporated to thereby form a getter film on the first substrate 81 (e.g., see, Japanese Patent Laid-Open Publication No. 5-114373). Besides a deposition technique, a paste coating technique for coating a paste mixed with getter material may also be employed to form the getter material layer 84 (e.g., see, Japanese Patent Laid-Open Publication No. 2-177234).

In a conventional fluorescent display device as shown in FIGS. 20A and 20B, there is needed a vessel accommodating getter material or a supporting member for supporting the vessel. An opening to attach the vessel to a substrate is also needed. Accordingly, fabrication cost of the vessel increases. The attachment of the vessel to the substrate is not technically easy. There is a limitation in an accommodating place of the vessel, e.g., the substrate in FIG. 20B. Further, since a considerable space is necessary for attachment of the vessel, a dead space increases, the dead space being a space which is not useful in a display function thereof.

In FIG. 20A, the vessel 75 of a particular shape and the supporting member 74 to attach the getter should be installed between the substrates 71 and 72. As a result, the size thereof becomes large and the structure thereof becomes complex; and the handling and attachment thereof become difficult. Especially, the handling or attachment of a thin fluorescent display device, e.g., having a space between two facing substrates smaller than 1.4 mm becomes difficult. Even if the attachment thereof is possible, since a distance between the getter material 76 and the first substrate 71 is small, evaporated getter material does not diffuse far away. Therefore, a getter film formed on the substrate 71 has small area and it is impossible to obtain full getter effect.

Since the fabrication cost of the vessel of a particular shape is high and the handling burden thereof is considerable, the manufacturing cost of the fluorescent display device becomes expensive. Further, spaces for the vessel of a ring shape and a getter attachment member become large, thereby entailing limitations in providing slim and small fluorescent display device.

In FIG. 20B, the thermal expansion coefficient of the first substrate 71 should be set as about equal to that of the vessel 77; and the first substrate 71 and the vessel 77 should be attached closely to each other to prevent the vacuum level of a vacuum vessel of the fluorescent display device being lowered. Therefore, it is necessary to fabricate the vessel 77 and an opening of the substrate attaching the vessel 77 in a high accuracy.

Referring to FIG. 21A, since a recessed portion should be formed in the second substrate 82, the substrate fabrication cost becomes high. Further, since the getter material to be filled in the recessed portion is powder, handling thereof is not easy and the filling procedure thereof is burdensome. Since the forming place of the recessed portion is limited within the substrate and a thin glass substrate of about 1 mm thickness is used in a thin fluorescent display device, the depth of the recessed portion is limited in view of the fact that a vacuum vessel thereof should be strong enough to endure an atmospheric pressure applied thereto. Accordingly, it is difficult to fill the recessed portion with the getter material in an amount required to form the getter film.

In the conventional fluorescent display device as shown in FIG. 21B, an expensive deposition unit is necessary for forming the getter material layer 84; and in forming the getter material, the patterning thereof is difficult. Further, since it is difficult to form the getter material layer 84 by employing a deposition technique on a component other than the substrate, the formation place of the getter material layer 84 is limited in the substrate.

Since the getter material layer 84 formed by employing a deposition technique is thin, the glass substrate may be locally over-heated depending on a radiation time duration of a laser beam irradiated thereon, thereby entailing a development of a crack in the substrate; and it is difficult to form the getter material layer in an amount required to form a getter film.

In the conventional fluorescent display device as shown in FIG. 21B, a paste coating technique instead of the deposition technique may be employed. However, when employing the paste coating technique, an expensive paste coating unit is needed; the pattering procedure in forming the getter material layer is difficult; and it is difficult to form the getter material layer on a component other than the substrate. Further, in this case, a mixture other than the getter material in the paste may be evaporated to thereby produce unnecessary gas.

For example, in manufacturing a fluorescent display device, e.g., made of an acryl, even if the paste is formed by employing a solvent such as one which is thermally decomposed in sealing and exhaust procedures, the adhesion force of the getter material is not sufficient. Accordingly, the getter material may be detached due to evaporation of the getter material or the vibration thereof.

SUMMARY OF THE INVENTION

It is, therefore, a primary object of the present invention to provide an electron tube capable of reducing installation space thereof, realizing simple handling and mounting thereof in any installation space, and a method for manufacturing the electron tube, the method activating a getter by irradiating a light on the getter.

In accordance with a preferred embodiment of the present invention, there is provided an electron tube having a ring-less getter of a tablet shape in a vessel, wherein a light is irradiated on the ring-less getter to thereby activate the ring-less getter.

In accordance with another preferred embodiment of the present invention, there is provide a method for manufacturing an electron tube including a front substrate and a back substrate, wherein a wiring and an electrode are formed on the front substrate and/or the back substrate; a component is mounted on the front substrate and/or the back substrate; a ring-less getter is mounted on at least one of the front substrate, the back substrate and the component; a vessel is assembled and sealed so that the front substrate faces the back substrate; a light is irradiated on the ring-less getter from outside of the sealed vessel, thereby activating the ring-less getter.

In accordance with yet another preferred embodiment of the present invention, there is provided a method for manufacturing an electron tube including a front substrate and a back substrate, wherein a wiring and an electrode are formed on the front substrate and/or the back substrate; a component having a ring-less getter of a tablet shape installed thereon is mounted on the front substrate and/or the back substrate; a vessel is assembled and sealed so that the front substrate faces the back substrate; a light is irradiated on the ring-less getter from outside of the sealed vessel, thereby activating the ring-less getter.

BRIEF DESCRIPTION OF THE DRAWINGS

The above and other objects and features of the present invention will become apparent from the following description of the preferred embodiments given in conjunction with the accompanying drawings, wherein.

DETAILED DESCRIPTION OF THE PREFERRED EMBODIMENTS

Figure 1A:
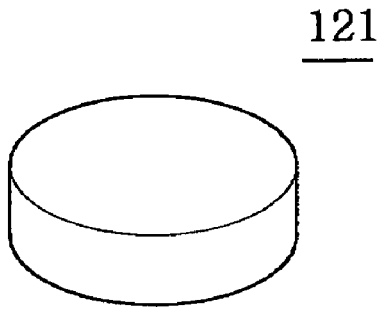
FIGS. 1A to 1C show respective schematic getter structures in accordance with preferred embodiments of the present invention.
Figure 1B:
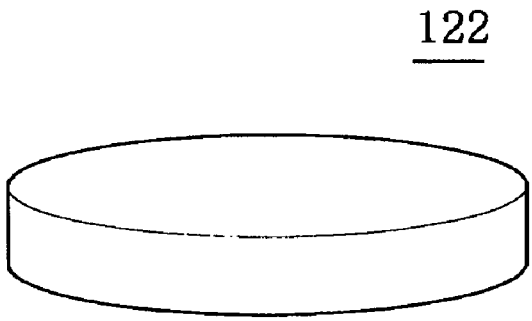
Figure 1C:
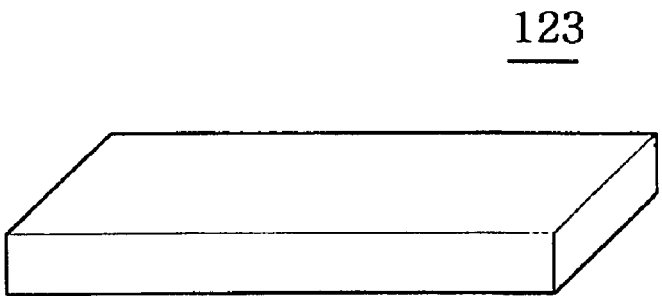

FIGS. 1A to 1C show respective schematic getter structures in accordance with preferred embodiments of the present invention. In the present invention, a getter of a tablet shape is formed by fabricating a getter material, e.g., a Ba—Al alloy. A getter 121 shown in FIG. 1A has a circular tablet shape. A getter 122 shown in FIG. 1B has an elliptic tablet shape. A getter 123 shown in FIG. 1C has a rectangular tablet shape. The getter of a tablet shape is formed by, e.g., crushing a pellet (e.g., a sphere or a chip) made of getter material or crushing getter material powder.

The size, shape and thickness of the getter material may be selected on the basis of conditions of an installation place of the getter material. A shape of a light beam (light/optical energy), e.g., a laser beam irradiated on the getter may be preferably selected corresponding to a shape of a slit or lens. As a result, a preferable laser beam having a preferable shape and size of the getter is adopted.

The getter of a tablet shape represents a getter made of a product rendered by preparing forming getter pellets of a tablet shape, a chip shape or a sheet shape. Since the getter of FIG. 1 is fabricated in a tablet shape, the getter material alone can be directly installed at a certain place of the fluorescent display device, which will be described in detail later. Further, since a main surface of the getter is flat, the getter may be used in a fluorescent display device as an electron tube of a thin type.

The thickness of the getter may range from several tens of μm to several hundreds of μm, preferably about 100 μm to about 300 μm. It is preferable that the getter is prepared with a thickness that is thick enough to provide full amount of the getter material to be evaporated. There entails no problem such as developing a crack in a substrate if the thickness of the getter is equal to or greater than about 100 μm while this thickness range depends on the output power of the laser.

If there is too much getter material, there entails waste of the getter material. Accordingly, it is preferable that the thickness of the getter ranges from about 100 μm to about 300 μm. In the present invention, the getter having a diameter ranging from about 0.2 mm to about 1.0 mm is used; and a laser beam, e.g., of a commercially available YAG laser, having a diameter ranging from about 0.2 mm to about 1.0 mm is used. The output power of the laser beam varies depending on the size of the laser beam. If a diameter of the laser beam is about 0.8 mm, the output power of the laser beam may be less than about 2.0 J while if a diameter of the laser beam is about 0.2 mm, the output power of the laser beam may be about 0.5 J. If the output of the laser beam is higher than the level mentioned above, a crack may be generated in a substrate. The size of the getter and the diameter of the laser beam are not limited to these values, respectively.

Figure 3A:
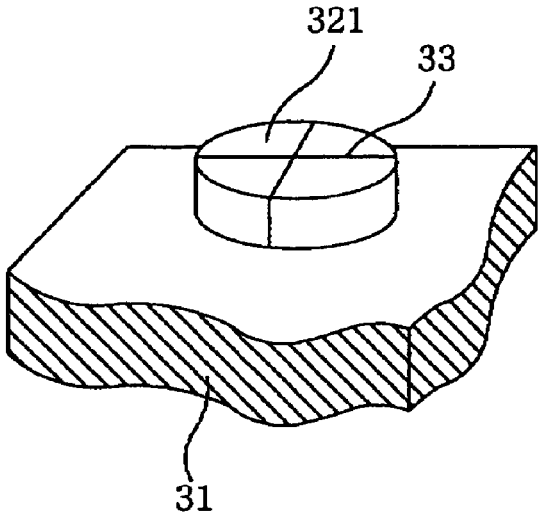
FIGS. 3A and 3B depict respective schematic attachment examples of getters in accordance with another preferred embodiments of the present invention.
Figure 3B:
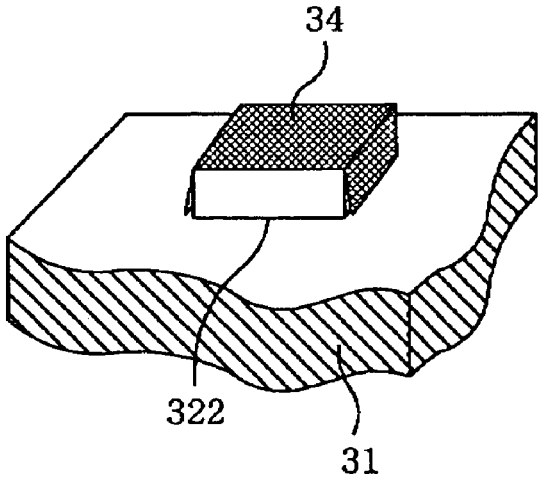
Figure 4:
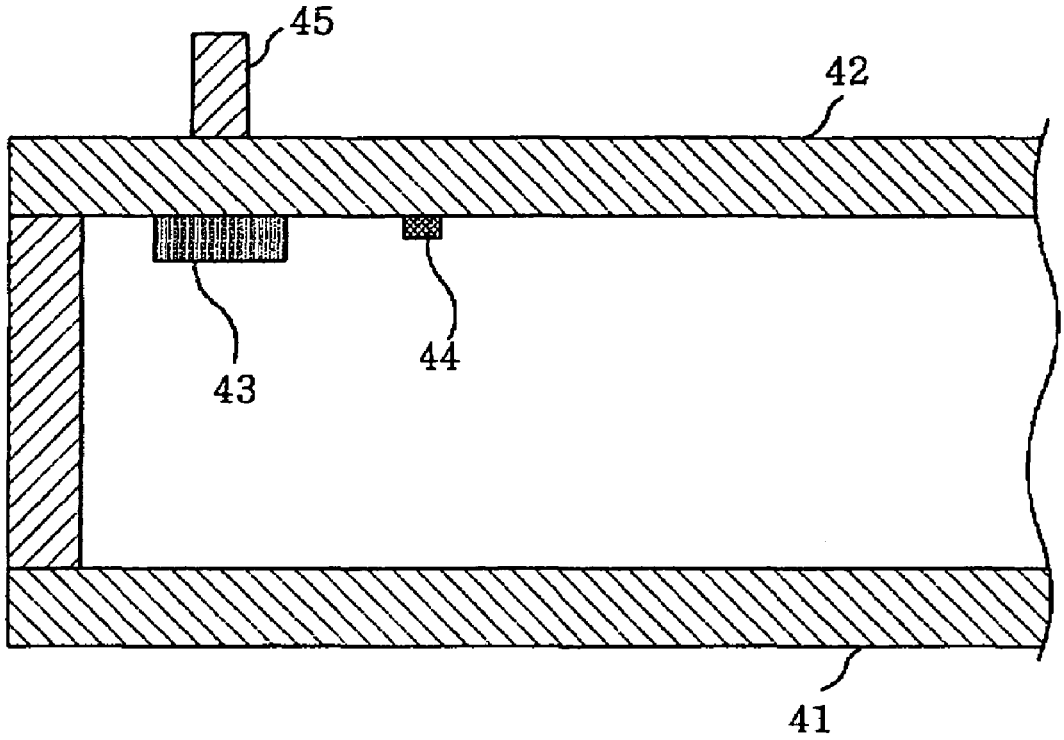
FIG. 4 presents a cross sectional diagram viewing attachment of a getter in accordance with a preferred embodiment of the present invention.

Each of FIGS. 2 to 4 illustrates a schematic diagram or a cross sectional diagram representing an attachment example of a getter in accordance with the preferred embodiments of the present invention.

Figure 2A:
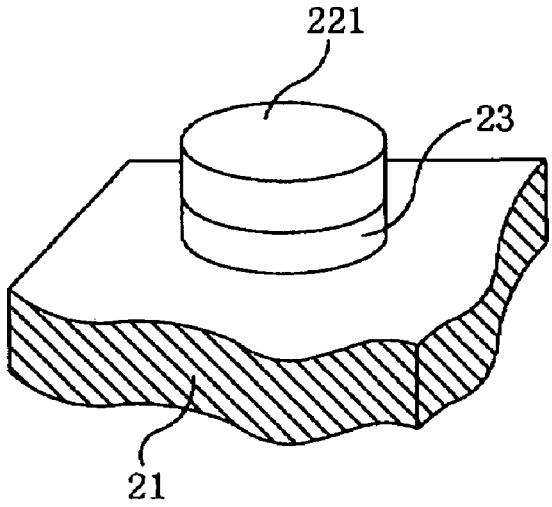
FIGS. 2A and 2B illustrate schematically attachment examples of getters in accordance with preferred embodiments of the present invention.

In FIG. 2A, a surface of the getter 221 parallel to the top surface of the substrate 21 made of base material is attached on the substrate by way of a frit glass 23. In this case, both the parallel surface and the side surface of the getter 221 to the top surface of the substrate 21 made of base material or only the side surface may be attached on the substrate by way of a frit glass 23. In both cases, the frit glass 23 is not attached to the evaporation surface of the getter 221. With this configuration, when the getter 221 is evaporated, the evaporation of the frit glass 23 can be prevented. The frit glass 23 may be replaced with indium (In), tin (Sn), indium alloy or tin alloy. In case of FIG. 2A, a recessed portion of a substrate or vessel accommodating getter material is not necessary while the recessed portion is needed in the prior art method.

Figure 2B:
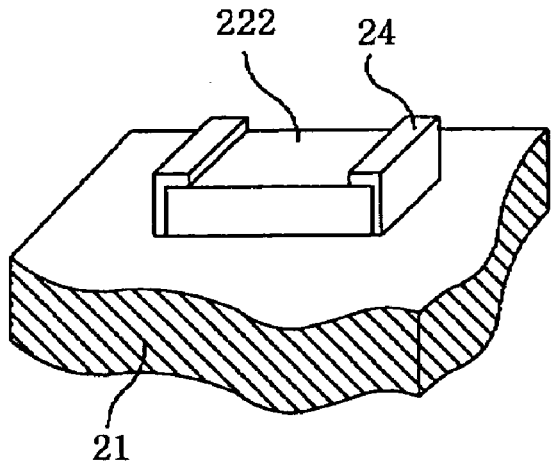

In FIG. 2B, a getter 222 is installed on the substrate 21 by using a metal jig 24. In FIG. 3A, a getter 321 is installed on the substrate 31 by using a wire 33. In FIG. 3B, a getter 322 is installed on the substrate 31 by using a metal mesh 34.

If each of the installation places of the metal jig 24 of FIG. 2B, the wire 33 of FIG. 3A and the metal mesh 34 of FIG. 3B is made of a metallic component (of an electron tube), each of the metal jig 24, the wire 33 and the metal mesh 34 may be installed by using a welding technique. By employing the metal jig 24 of FIG. 2B, the wire 33 of FIG. 3A and the metal mesh 34 of FIG. 3B to support or mount corresponding formed getters, a vessel accommodating these becomes structurally simpler and costs less than for the case of the prior art. Further, the installation thereof becomes also simple.

FIG. 4 presents a cross sectional diagram viewing attachment of a getter in accordance with a preferred embodiment of the present invention. In FIG. 4, a getter 43 is maintained by employing an external magnet 45 in a fluorescent display device having substrates 41 and 42. In this structure, a laser beam is irradiated on the getter 43 to evaporate the getter 43, thereby forming a getter film on the substrate 41. A remaining part of the getter 43 which has not been evaporated is moved to a welding part 44 by the magnet 45 and is welded to the welding part 44. The welding part 44 may be made of, e.g., Indium (In), Tin (Sn) or an alloy of In and Sn. In this structure of FIG. 4, there is no need to fix the getter 43 or to prepare a supporting member of the getter 43.

Figure 5A:
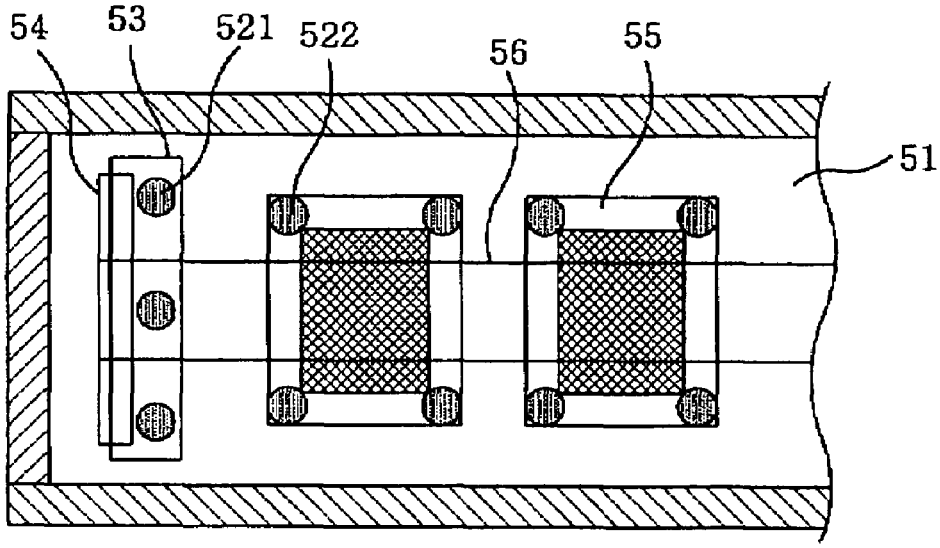
FIGS. 5A to 5C set forth respective cross sectional diagrams viewing attachment places of getters in accordance with preferred embodiments of the present invention.

FIGS. 5 and 6 set forth cross sectional diagrams and schematic diagrams, respectively, viewing attachment places of getters in accordance with preferred embodiments of the present invention. In FIG. 5A, a getter 521 is attached to a metal plate 53 having a supporting member 54 (further, having a metal lead) of a filament 56 as an electron source installed thereon. The getter 522 is attached to a frame 55 of a grid. In this case, after a getter is attached to a component, e.g., a grid, the component may be installed on the substrate 51. Since the getters 521 and 522 are installed on the metal plate 53 or the frame 55 of the grid in FIG. 5A, a supporting member in attaching the getter is not necessary; and the metal plate 53 and the frame 55, which are located between fluorescent materials, are not directly related with the display thereof; and accordingly, they may be used in attaching the getter to thereby effectively use a dead place thereof.

A crack may be developed in the substrate and an insulation layer or a wiring under the insulation layer may be damaged when a getter is installed on the substrate or on the insulation layer formed on the substrate and a laser beam is focused on the substrate or the insulation layer or when a getter is installed on the substrate or on the insulation layer formed on the substrate and the laser beam deviates from the getter. But, the plate 53 and the frame 55 do not suffer from a crack since both of them are metals.

Figure 5B:
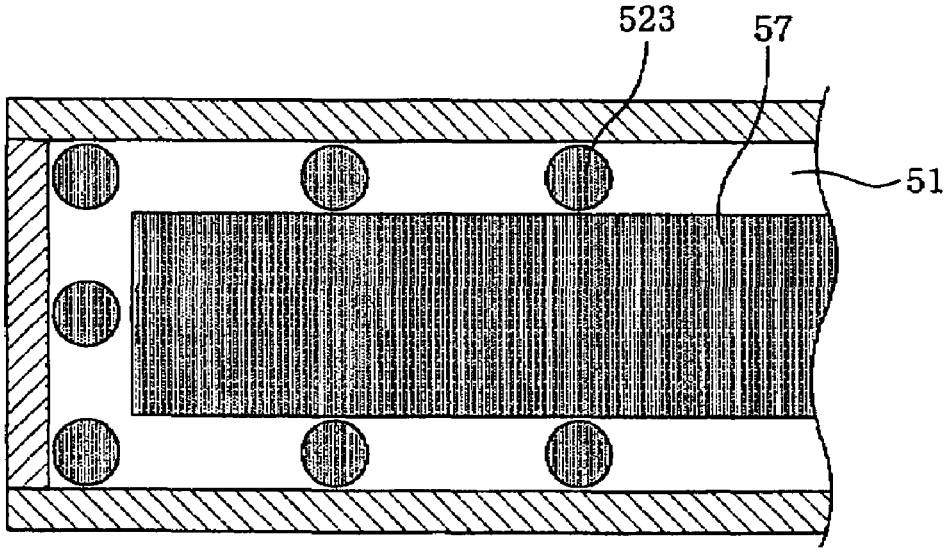

In FIG. 5B, a getter 523 is installed in a periphery of a display region 57 of a substrate 51, wherein the periphery does not influence on the display thereof. In this case, a getter may be installed in the substrate prior to installation of a component such as a grid on the substrate. In case of FIG. 5B, since a getter may be installed between the supporting member 54 of the filament 56 and a side plate of FIG. 5A or at four corners thereof, an area of the getter film can be increased. Further, since the getter film can be formed on the side plate as well as the front substrate if the getter is installed near to the side plate, an area of the getter film can be further increased.

Figure 5C:
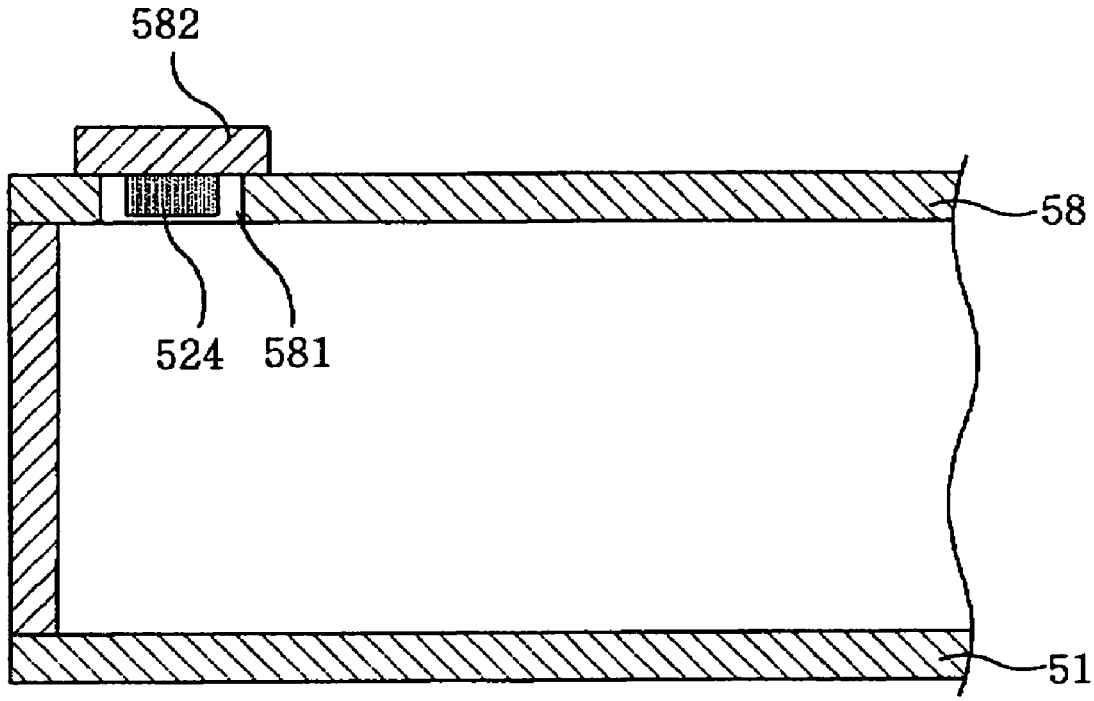

In FIG. 5C, a getter 524 is installed on an inner surface of an exhaust cap 582 covering an exhaust hole 581 of the substrate 58. In this case, the fluorescent display device is exhausted through the exhaust hole 581 and the exhaust hole 581 is closed after completion of the exhaust operation thereof with the exhaust cap 582 that has been heated to a high temperature. Accordingly, the getter 524 is sealed within the fluorescent display device in the state of FIG. 5C after exhausting unnecessary gas attached thereon.

Further, in this case, since the getter 524, is accommodated in the exhaust hole 581, a mounting hole to attach a vessel accommodating getter material or a recessed portion to fulfill the getter material in the prior art is not needed to form on the substrate.

Figure 6A:
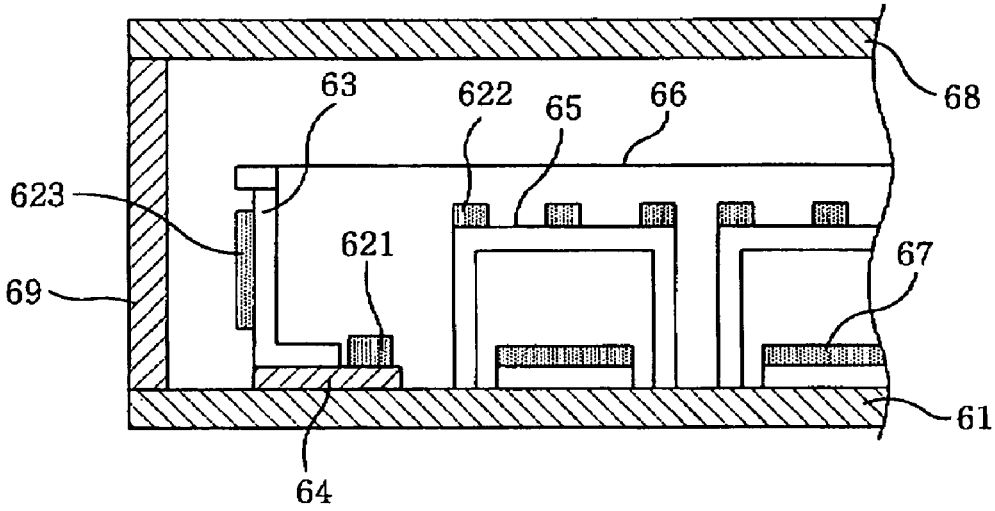
FIGS. 6A and 6B provide a cross sectional diagram and a schematic diagram viewing attachment places of getters, respectively, in accordance with preferred embodiments of the present invention.

In FIG. 6A, getters 621, 623 and 622 are installed on a plate 64, a supporting member 63 of a filament 66 and a frame 65 of a grid, respectively. A getter film is formed on a substrate 68 and a side plate 69 by irradiating a laser beam on the getters 621, 622 and 623. A reference numeral 67 represents a fluorescent material coated on an anode electrode.

In FIG. 6A, since the side plate 69 is not related to the display thereof, the number and size of the getter 623 may be selected to be those values favorable for forming a getter film on front surface of the side plate 69. Since light emission of the fluorescent display device is observed through the substrate 61 when the fluorescent display device is a transmitting one (i.e., front light emitting type), the front surface thereof may be coated with the getter film because the substrate 68 is not related to the display thereof. Accordingly, in this case, a plurality of getters 621 and 622 may be installed at certain places.

Figure 6B:
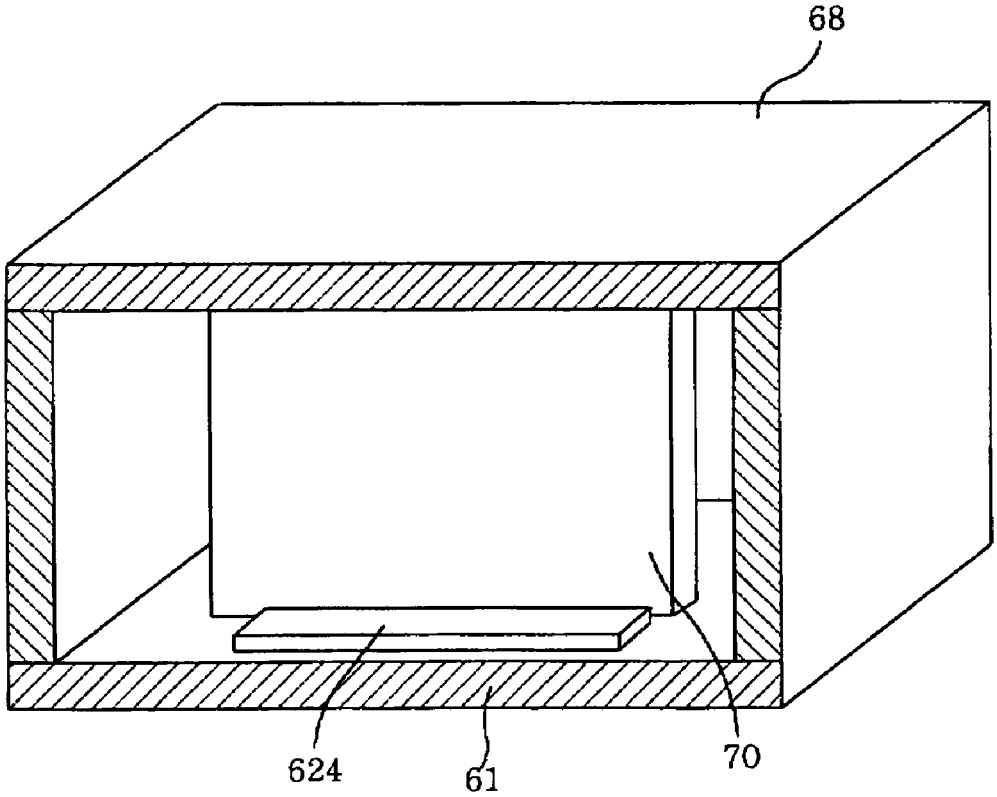

In FIG. 6B, an isolation wall 70 is installed at a boundary between a display region and a non-display region of a fluorescent display device to thereby divide the inner space of the fluorescent display device into two parts and a getter 624 is installed in the non-display region thereof. In FIG. 6B, the getter 624 is installed on the substrate 61, but, the getter 624 may be installed on the isolating wall 70 or the substrate 68.

The installation places of the getters are not limited to the places illustrated in FIGS. 5 and 6; but the getters may be installed in other places corresponding to other substrate or other component. The installation places are selected in such a way that a getter film formed by evaporating the getter material does not prevent the display of the fluorescent display device in view of the arrangement of the anode.

A getter of a tablet shape of the present invention may be selected as one having a certain size, thickness and shape. Accordingly, the getter of the present invention may be designed and fabricated in accordance with a corresponding installation place thereof. From now on, a manufacturing method of a fluorescent display device as an electron tube will be described.

First, as in the case of manufacturing a conventional fluorescent display device, a wiring or an electrode is formed on a front substrate and/or a back substrate. A space between the front substrate and the back substrate may be equal to or smaller than 1.4 mm. Alternatively, the space between the front substrate and the back substrate may be equal to or smaller than 2 mm. Then, components such as a filament supporting member and a grid are installed. Thereafter, a getter of a tablet shape is installed by employing one of methods of FIGS. 2, 3 and 4 or a combination method thereof at one of places shown in FIGS. 5 and 6 or a combination place thereof. Next, a vacuum vessel is assembled to face the front substrate and the back substrate by way of the side plate and then the vacuum vessel is evacuated and sealed. A getter film is formed in the vacuum vessel by irradiating a laser beam onto the getter of a tablet shape to evaporate the getter in an opposite direction to the radiation direction of the laser beam. A laser beam is irradiated from outside the sealed vacuum vessel onto the getter of the tablet shape to selectively heat the getter, thereby activating the getter by rendering the temperature of the getter to reach an activation temperature. As a result, a fluorescent display device is manufactured.

It is possible that a component such as a grid having a getter of a tablet shape previously installed thereon is installed on the substrate. It is also possible that a component such as a grid is installed on the substrate having a getter of a tablet shape previously installed thereon.

Figure 7A:
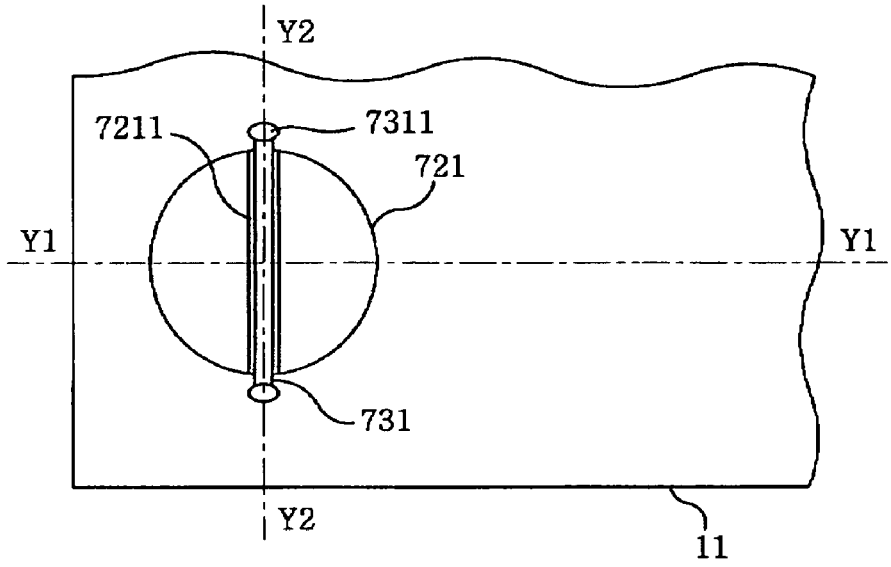
FIGS. 7A to 7C give a plan view and cross sectional diagrams, respectively, of a fluorescent display device having a getter attachment unit employing an ultrasonic bonding technique in accordance with a first preferred embodiment of the present invention.
Figure 7B:
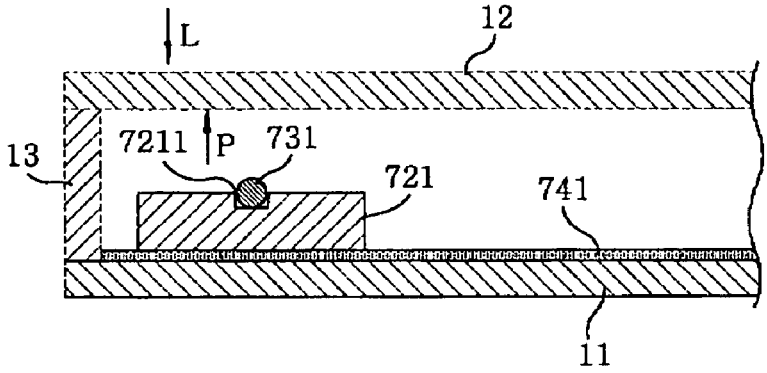
Figure 7C:
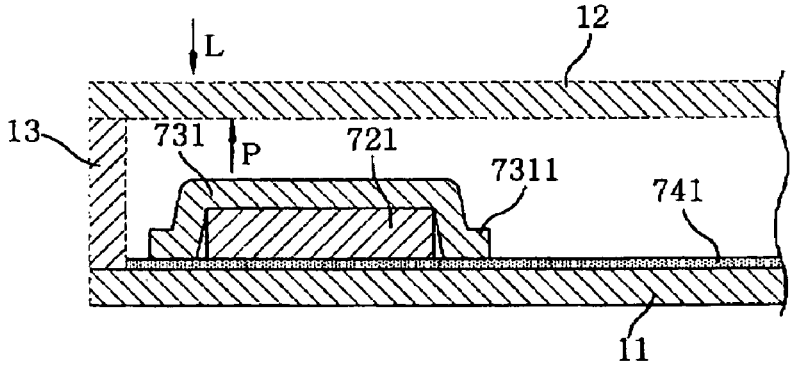

Next, a getter attachment case in accordance with a first preferred embodiment of the present invention, which employs an ultrasonic bonding technique will be described. FIGS. 7A to 7C give a plan view and cross sectional diagrams, respectively, of a fluorescent display device having a getter attachment unit employing an ultrasonic bonding technique in accordance with a first preferred embodiment of the present invention.

FIG. 7A gives a plan view of a first substrate; and FIGS. 7B and 7C represent schematic cross sectional diagrams taken along lines Y1-Y1 and Y2-Y2, respectively, of a fluorescent display device given in FIG. 7A. FIGS. 7B and 7C represent a second substrate and a side plate as broken lines, which will be described later.

In FIG. 7, a getter of a disc shape is installed on an Al thin film. In FIG. 7, reference numerals 11, 12 and 13 represent a first substrate, a second substrate and a side plate, respectively, which form a vacuum vessel of a fluorescent display device as base plates thereof; and reference numerals 721, 731 and 741 represent a getter, an Al wire as a metal wire and an Al thin film as a metal layer, respectively.

The getter 721 is a ring-less getter which does not use a ring-shaped vessel for accommodating getter material. The getter 721 is formed by employing getter material, e.g., a Ba—Al alloy by using a mold through a pressing procedure. The getter 721 has a recessed portion 7211 on a surface of a disc, wherein this recessed portion 7211 may be formed when forming the getter 721 or after the formation of the getter. The Al wire 731 is inserted in the recessed portion 7211 of the getter 721 and is attached to the Al thin film 741 by performing an ultrasonic welding on two end portions 7311. The getter 721 is supported between the Al wire 731 and the Al thin film 741.

Since the Al wire 731 is fitted in the recessed portion 7211, the getter 721 is not moved even when the Al wire 731 is not hanged tightly to the getter 721. The Al thin film 741 may be formed on a front surface contacting the getter 721 or only on a portion that the Al wire 731 is welded. When a laser beam is irradiated on the getter 721 along a direction represented by an arrow (L) in the sealed fluorescent display device, the getter 721 is evaporated. The particles of the evaporated getter fly along a direction represented by an arrow (P) to thereby form a getter film on an inner surface of the second substrate 12.

In this preferred embodiment of the present invention, the diameter and the thickness of the getter 721 are about 2.0 mm and about 0.3 mm, respectively; and the Al wire has a thickness of about 0.2 mm and the Al thin film 741 has a thickness of about 1.2 μm.

Since the getter is a ring-less getter in this preferred embodiment of the present invention, the getter material is not accommodated in an accommodation vessel. Accordingly, the getter can be directly installed in the vacuum vessel. Therefore, the fabrication of a getter accommodation vessel is not needed and a unit used in installing the getter accommodation vessel is not necessary. As a result, the fabrication cost decreases and installation becomes easy. Since the getter in this preferred embodiment of the present invention can be installed without an additional supporting member, the space needed to install the getter can be reduced. Further, since the getter may be formed in a certain shape, size and thickness in accordance with the installation places of the getter, the space in the vacuum vessel can be effectively utilized.

Since an adhesive material such as a frit glass is not used in the preferred embodiments of the present invention, there entails no gas during baking process of the fluorescent display device or evaporation of the getter. Further, since the getter is fixed by employing the Al wire, it is possible to fix the getter more tightly without considering the thermal expansion coefficient of a corresponding supporting member or a mounting member.

Figure 8A:
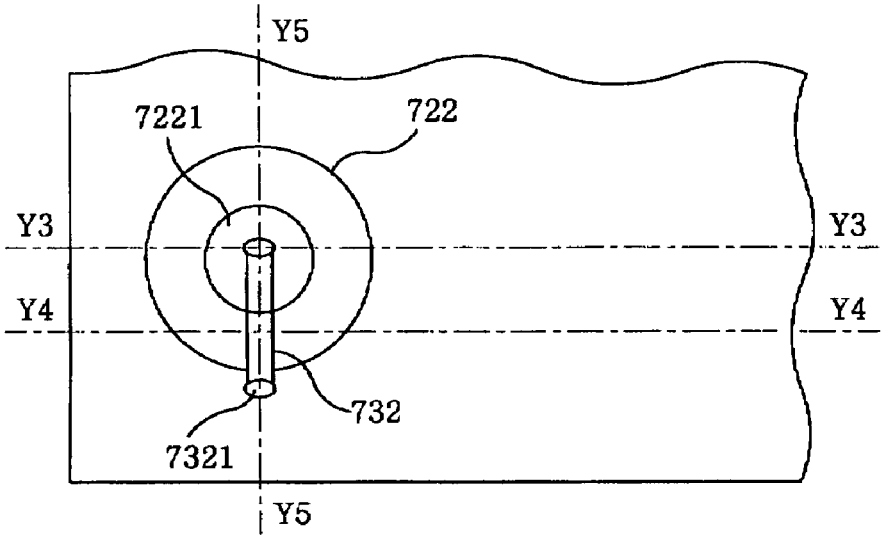
FIGS. 8A to 8C give a plan view and cross sectional diagrams, respectively, of a fluorescent display device having a getter attachment unit employing an ultrasonic bonding technique in accordance with a second preferred embodiment of the present invention.
Figure 8B:
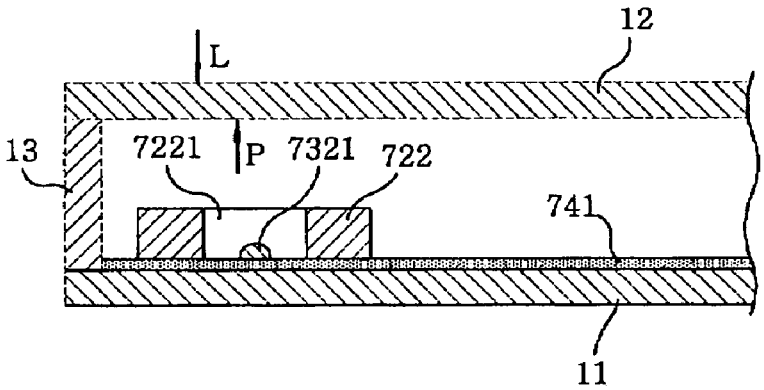
Figure 8C:
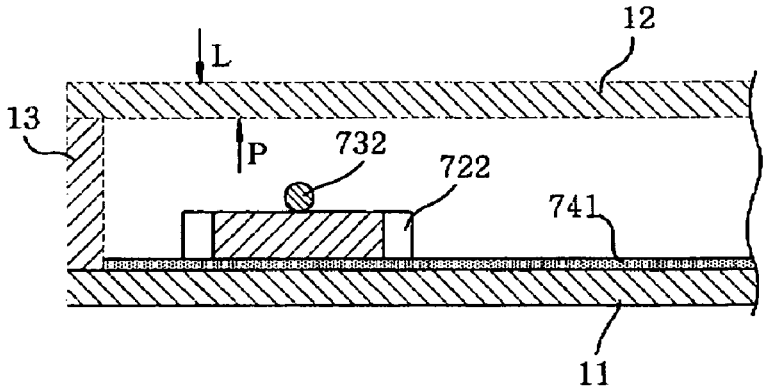
Figure 9:
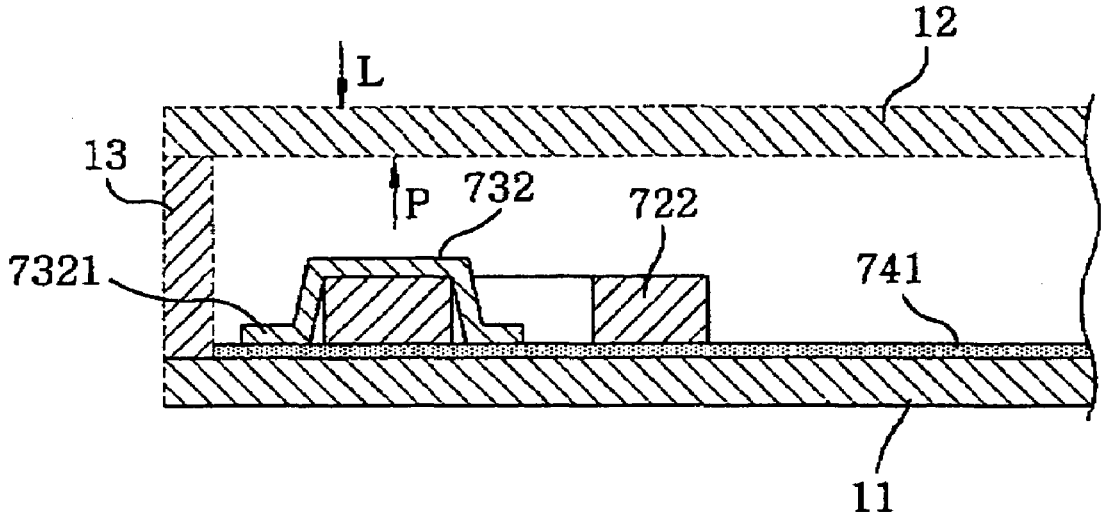
FIG. 9 represents a cross sectional diagram of the fluorescent display device given in FIGS. 8A to 8C.

FIGS. 8 and 9 show plan views and cross sectional diagrams of a fluorescent display device having a getter attachment unit employing an ultrasonic bonding technique in accordance with a second preferred embodiment of the present invention. FIG. 8A illustrates a partial plan view of a first substrate. FIGS. 8B and 8C represent cross sectional views taken along lines Y3-Y3 and Y4-Y4, respectively, of FIG. 8A. FIG. 9 gives a cross sectional view taken along a line Y5-Y5 of FIG. 8A. In FIGS. 8 and 9, like reference numerals represent like parts shown in FIG. 7. In FIGS. 8 and 9, a ring-less getter having an opening formed in a disc shape at a center portion thereof is attached to an Al thin film on a substrate.

The getter 722 is formed by pressing getter material using a predetermined frame. The getter 722 has an opening 7221 at a center portion of a disc-shaped plate, wherein the opening 7221 may be formed before or after the formation of the getter 722. Two end portions 7321 of the Al wire 732 of the getter 722 are fixed to the Al thin film 741 by employing an ultrasonic welding technique. In this case, one end portion 7221 of the Al wire 732 is welded within the opening 7221. The Al thin film 741 may be formed only on the portion where the Al wire 732 is welded as shown in FIG. 7.

Figure 10A:
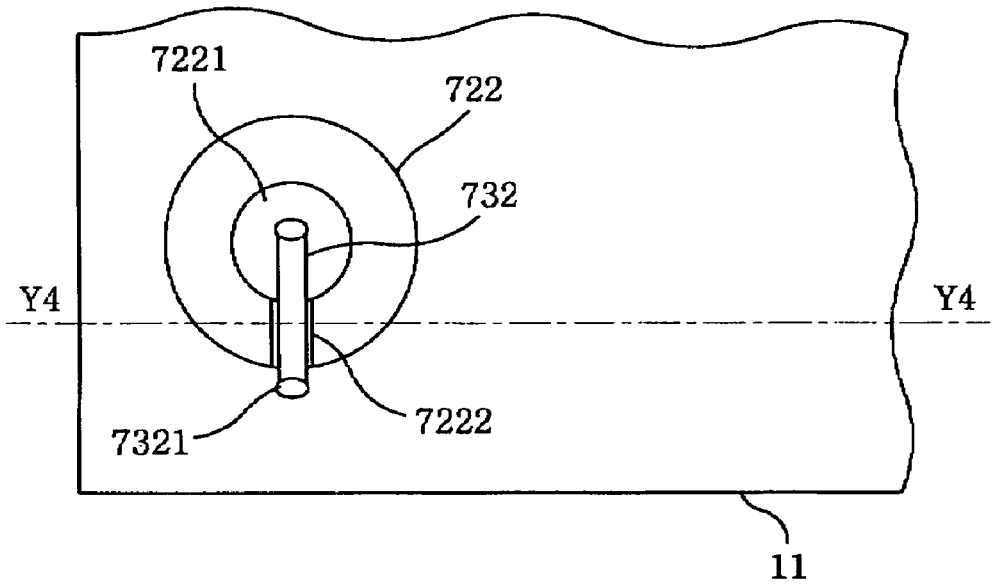
FIGS. 10A and 10B set forth a plan view and a cross sectional diagram, respectively, of a fluorescent display device made by modifying the fluorescent display device of FIG. 9.
Figure 10B:
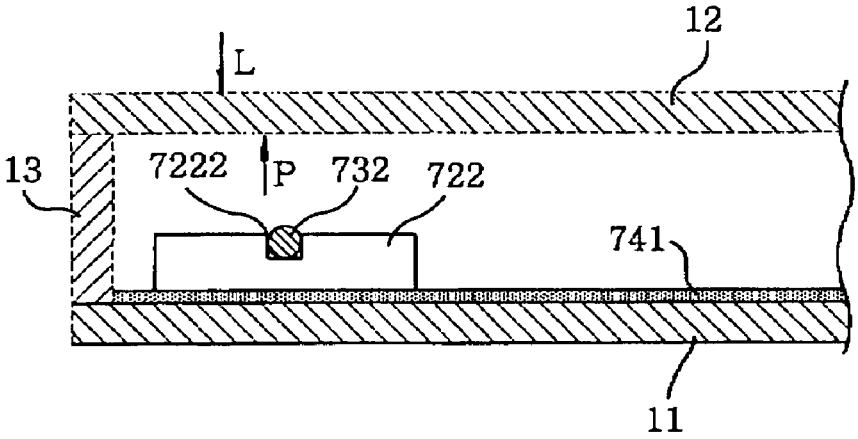

Generally, a ring-less getter has a small mechanical strength. But, the getter 722 of this embodiment can be formed in a thin type since there is no need to form a recessed portion in which an Al wire is inserted at a surface thereof. FIGS. 10A and 10B set forth a plan view and a cross sectional diagram, respectively, of a fluorescent display device made by modifying the fluorescent display device of FIGS. 8 and 9. In FIG. 10, like reference numerals represent like parts shown in FIGS. 8 and 9. FIG. 10B presents a cross sectional view taken along a line Y4-Y4 of FIG. 10A.

A recessed portion 7222 is formed in the getter 722, wherein an Al wire 732 is inserted in the recessed portion 7222. In FIG. 10, since the Al wire 732 is inserted in the recessed portion 7222, the getter 722 is not moved even when the Al wire 732 is not hanged tightly to the getter 722.

Figure 11A:
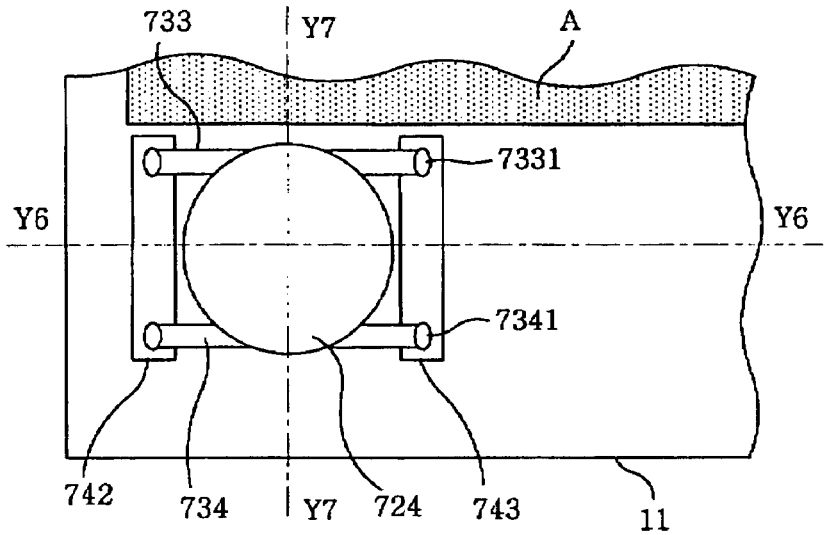
FIGS. 11A to 11C show a plan view and cross sectional diagrams, respectively, of a fluorescent display device having a getter attachment unit employing an ultrasonic bonding technique in accordance with a third preferred embodiment of the present invention.
Figure 11B:
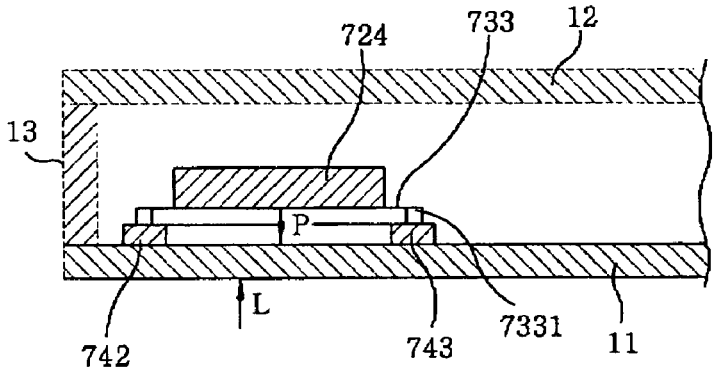
Figure 11C:
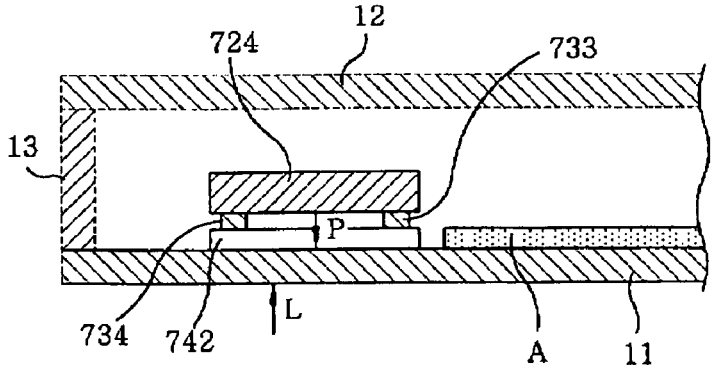

FIGS. 11A to 11C show a plan view and cross sectional diagrams, respectively, of a fluorescent display device having a getter attachment unit employing an ultrasonic bonding technique in accordance with a third preferred embodiment of the present invention.

FIG. 11A illustrates a partial plan view of a first substrate. FIGS. 11B and 11C represent cross sectional views taken along lines Y6-Y6 and Y7-Y7, respectively, of FIG. 11A. In FIG. 11, like reference numerals represent like parts shown in FIG. 7.

In FIG. 11, a reference numeral 724 represents a ring-less getter; reference numerals 733 and 734 represent Al wires; reference numerals 742 and 743 represent Al thin films formed on the glass substrate 11; and a reference numeral "A" represents a display region thereof. The Al wires 733 and 734 are fitted to the getter 724, e.g., by welding.

Two end portions 7331 and 7341 of the Al wires 733 and 734 are fixed to the Al thin films 742 and 743 by employing an ultrasonic welding technique. In FIG. 11, when a laser beam is irradiated on the getter 724 along a direction represented by an arrow (L), the getter 724 is evaporated. The particles of the evaporated getter fly along the direction represented by an arrow (P) to thereby form a getter film on an inner surface of the first substrate 11. The formation range of the getter will be described later.

Figure 12A:
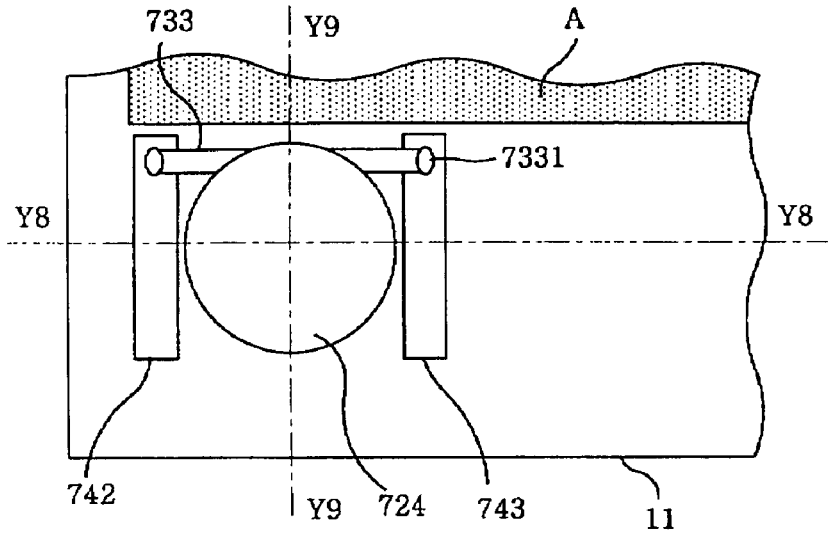
FIGS. 12A to 12C represent a plan view and cross sectional diagrams, respectively, of a fluorescent display device made by modifying the fluorescent display device given in FIGS. 11A to 11C.
Figure 12B:
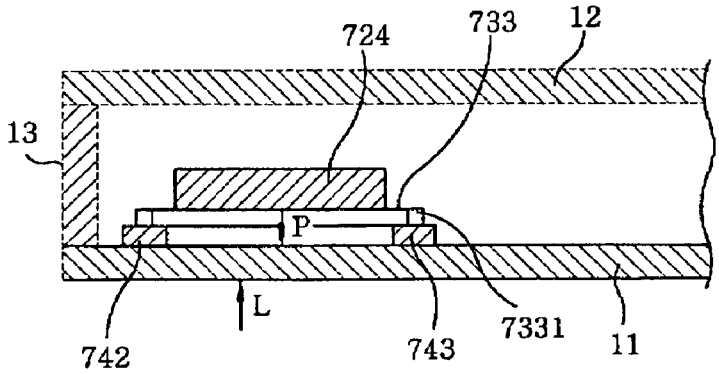
Figure 12C:
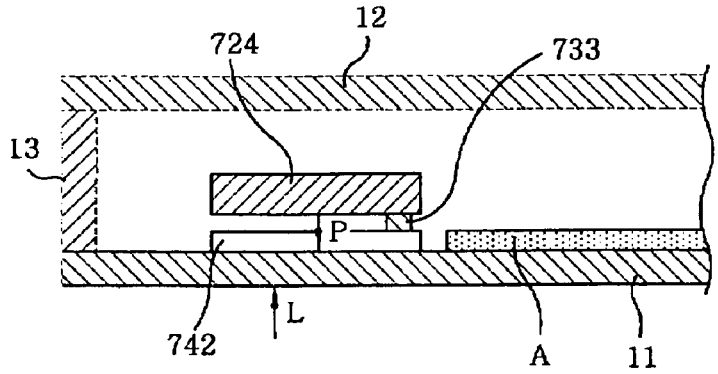

FIG. 12 represents a plan view and cross sectional diagrams of a fluorescent display device made by modifying the fluorescent display device given in FIGS. 11A to 11C. In FIG. 12, like reference numerals represent like parts shown in FIG. 11. FIG. 12A illustrates a partial plan view of a first substrate. FIGS. 12B and 12C represent cross sectional views taken along lines Y8-Y8 and Y9-Y9, respectively, of FIG. 12A.

In FIG. 12, an Al wire 733 near the display region A side is retained, while the Al wire 734 is eliminated from the opposite side thereof in comparison with FIG. 11, to thereby simplify the structure thereof. Since the getter 724 has a diameter of about 2 mm as described in FIG. 7, an Al wire may-be one line. If the getter is not large enough to provide a desired strength thereof, two Al lines may be utilized as in the case of FIG. 11. The Al wire 733 is described later referring to FIG. 14.

Figure 13A:
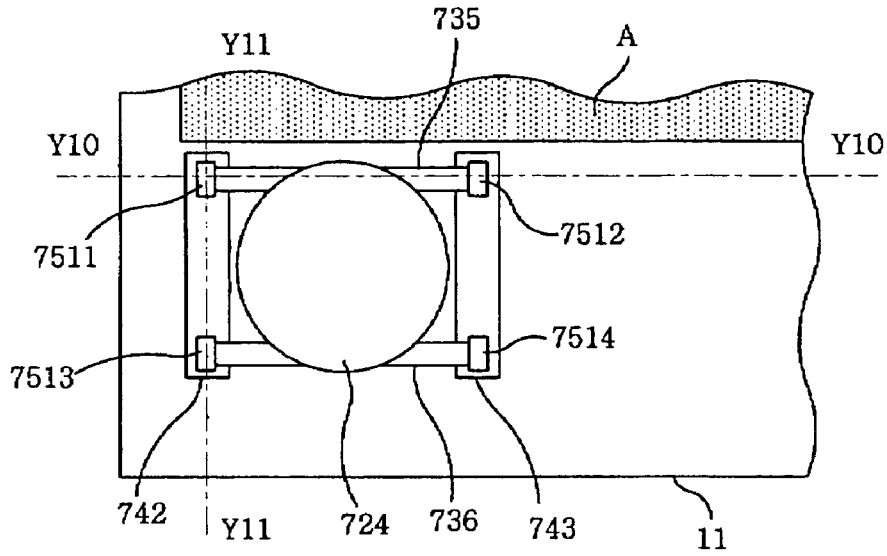
FIGS. 13A to 13C present a plan view and cross sectional diagrams, respectively, of a fluorescent display device having a getter attachment unit employing an ultrasonic bonding technique in accordance with a fourth preferred embodiment of the present invention.
Figure 13B:
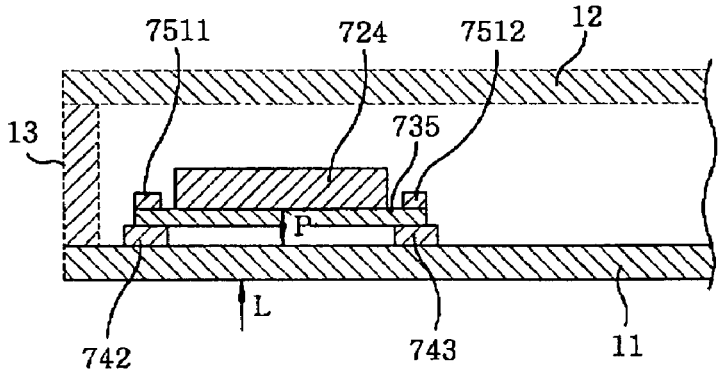
Figure 13C:
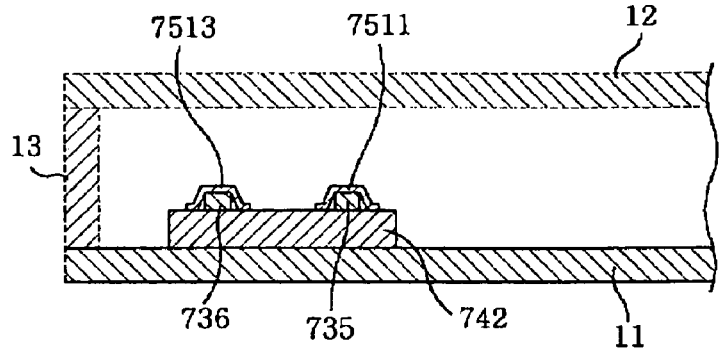

FIGS. 13A to 13C present a plan view and cross sectional diagrams, respectively, of a fluorescent display device having a getter attachment unit employing an ultrasonic bonding technique in accordance with a fourth preferred embodiment of the present invention.

FIG. 13A illustrates a partial plan view of a first substrate. FIGS. 13B and 13C represent cross sectional views taken along lines Y10-Y11 and Y11-Y11, respectively, of FIG. 13A. In FIG. 13, a display region (A) thereof is eliminated. In FIG. 13, like reference numerals represent like parts as shown in FIG. 11 since the fluorescent display device of FIG. 13 is structurally similar to that of FIG. 11.

In FIG. 13, each of reference numerals 735 and 736 represents a metal line, e.g., made of a stainless steel; reference numerals 7511 to 7514 represent Al parts or Al wires to fix metal lines 735 and 736. The getter 724 is installed to the substrate 11 by ultrasonic welding the Al parts 7511 to 7514 on the Al thin films 742 and 743, wherein two end portions of the metal lines 735 and 736 are fitted between the Al parts 7511 to 7514 and the Al thin films 742 and 743.

In the fourth preferred embodiment of the present invention, since the metal lines 735 and 736 are made of materials different from the Al thin films 742 and 743, the metal lines 735 and 736 are preferably selected in case that the ultrasonic welding on the Al thin films 742 and 43 is difficult. If the metal lines 735 and 736 can be welded by employing an ultrasonic welding technique on the Al thin films 742 and 743, two end portions of the metal lines 735 and 736 can be directly welded on the Al thin films 742 and 743 without employing the Al parts 7511 to 7514 as in the case of FIG. 11.

Figure 14A:
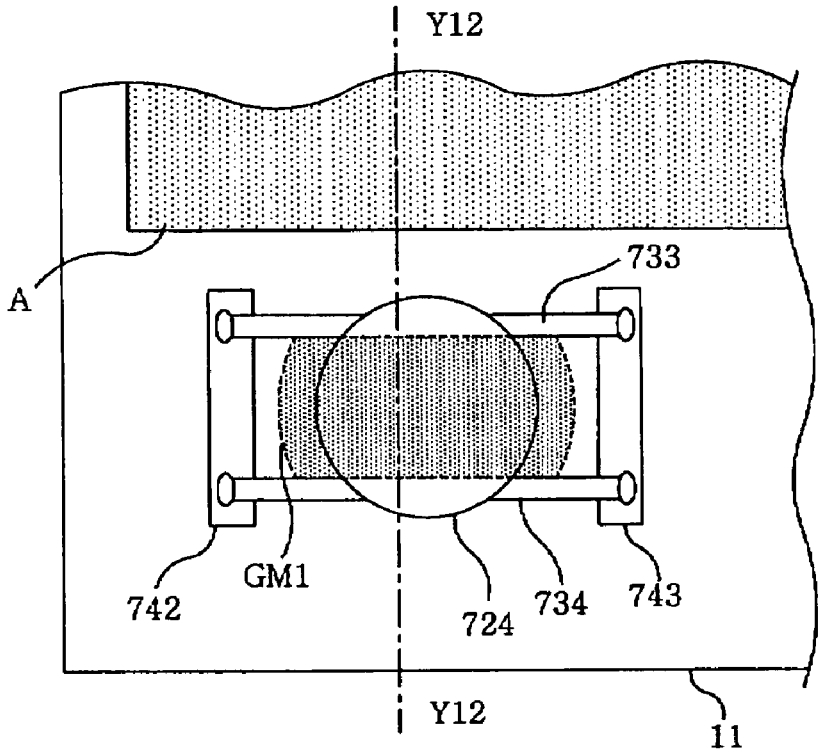
FIGS. 14A and 14B set forth a plan view and a cross sectional diagram, respectively, representing the operation of the fluorescent display device shown in FIGS. 11A to 11C.
Figure 14B:
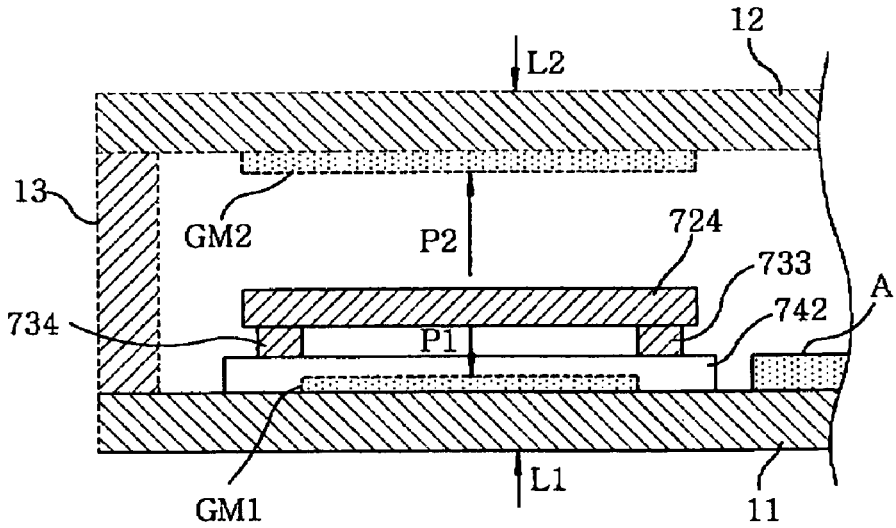

FIGS. 14A and 14B set forth a partial plan view and a cross sectional diagram, respectively, revealing a range of a getter film formation. FIG. 14A illustrates a plan view of a first substrate. FIG. 14B represents a cross sectional view taken along a line Y12-Y12 of FIG. 14A. In FIG. 14, like reference numerals represent like parts shown in FIG. 11.

Referring to FIG. 14B, when a laser beam is irradiated on the getter 724 along a direction represented by an arrow L1, the getter 724 is evaporated. The particles of the evaporated getter fly along a direction represented by an arrow P1 to thereby form a getter film GM1 on an inner surface of the first substrate 11 having the getter 724 attached thereto. In this case, since the Al lines 733 and 734 prevent the evaporated particles of the getter from flying toward outside the Al lines 733 and 734, the getter film GM1 is formed in a region between the Al line 733 and the Al line 734. Therefore, the getter 724 can be arranged closely to a display region A, thereby reducing the size of a dead space therein. Further, since the getter film GM1 is formed inside the substrate having the getter 724 even when a component is located between, e.g., the first substrate 11 and the second substrate 12, the evaporated particles of the getter 724 do not fly toward the component.

When a laser beam is irradiated on the getter 724, a part of the getter 724 that receives the laser beam is evaporated and the other part of the getter 724 still exists even when the getter film GM1 has been formed. Accordingly, the getter film GM1 absorbs gas flowing between the getter 724 and the getter film GM1. In this respect, it is preferable that a space between the getter 724 and the getter film GM1 (the substrate 11) is large. Referring to FIG. 14, by changing a diameter of the Al lines 733 and 734, the spacing between the getter 724 and the getter film GM1 (the substrate 11) can be changed.

In FIG. 14, the laser beam can also be irradiated along a direction represented by an arrow L2. In this case, the particles of the evaporated getter fly along a direction represented by an arrow P2 to thereby form a getter film GM2 on an inner surface of the second substrate 12. When there is no component between the getter 724 and the second substrate 12, a laser beam is irradiated on the getter 724 along directions L1 and L2, thereby forming getter films GM1 and GM2 on inner surfaces of the first substrate 11 and the second substrate 12, respectively. Namely, two getter films can be formed with one getter. As a result, the getter film is efficiently formed and an area of the getter film increases to thereby enhance a getter effect thereof. The effect of the fluorescent display device depicted in FIG. 14 is the same as that depicted in FIG. 12 or FIG. 13.

The arrangement of a ring-less getter is the same as that of FIG. 5 or FIG. 6 when the getter is installed through the use of a getter installation unit by employing an ultrasonic bonding technique. The getter may be installed on the second substrate facing to the first substrate or the side plate.

By employing the getter installation unit in accordance with the preferred embodiment of the present invention, the getter may be installed in a component as well as in a substrate of a vacuum vessel of a fluorescent display device.

In the preferred embodiments, while a cross sectional shape of an Al line or a metal line is described as a round shape, the cross sectional shape thereof may be a rectangle, a polygon or an ellipsoid, etc.

In the preferred embodiments, there are used a combination of an Al line, e.g., an Al wire and an Al thin film for installation of a getter or a combination of an Al part having a metal line fitted thereto for getter installation and an Al thin film for installation of a getter; but not limited to this. Another combination of a metal wire (or a metal part) and a metal thin film, e.g., a gold wire (or a gold part) and a gold thin film or a nickel wire (or a nickel part) and a nickel thin film may be used. For all these combinations of metals, a welding thereof is possible. In the above cases, the Al film or the metal film may not be thin; and may be formed by employing a deposition, a sputtering or a plating technique.

In the preferred embodiments of the present invention, the Al wire or the metal wire for installation of the getter has been fitted by employing an ultrasonic welding technique but another welding technique, e.g., a resistance welding and a laser welding technique may be employed. When the metal film to fit the Al wire or the metal wire is a thin film, the ultrasonic welding technique is more preferable in consideration of influence of heat on the metal film. From now on, an embodiment to install a getter by employing an ultrasonic bonding technique will be described.

Figure 15A:
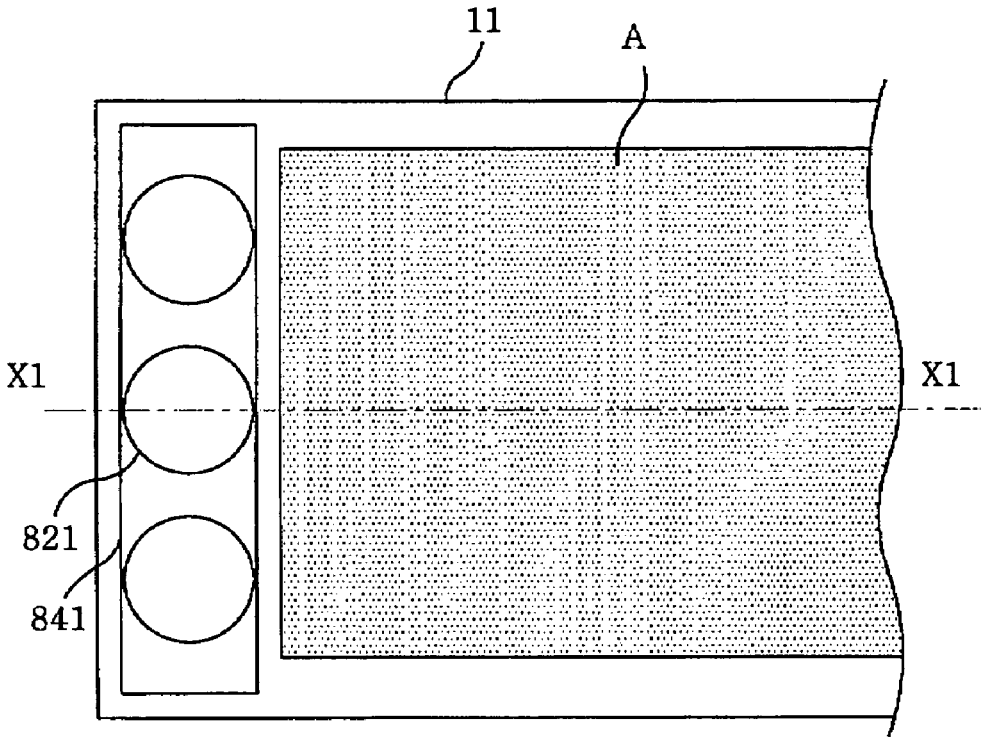
FIGS. 15A and 15B represent a plan view and a cross sectional diagram, respectively, of a fluorescent display device having a ring-less getter installed therein employing an ultrasonic bonding technique in accordance with the first preferred embodiment of the present invention.
Figure 15B:
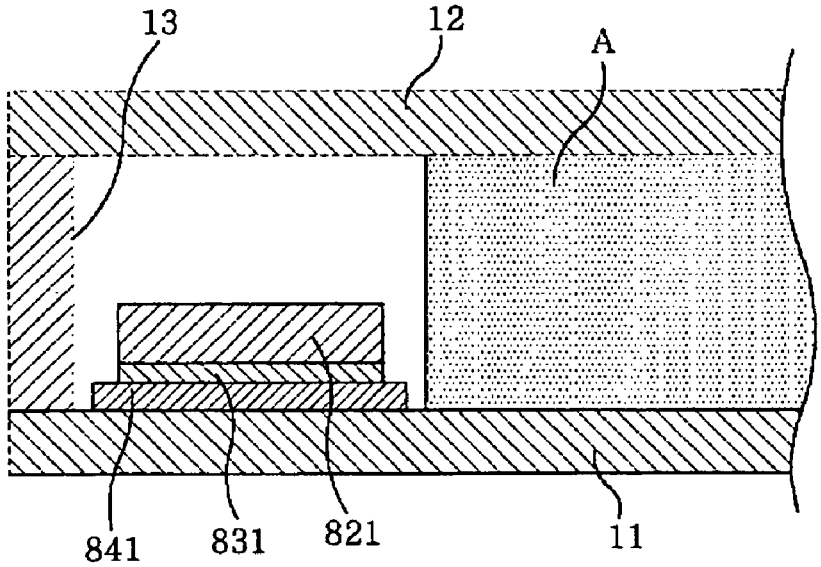

FIGS. 15A and 15B represent a plan view and a cross sectional diagram, respectively, of a fluorescent display device having a ring-less getter installed therein employing an ultrasonic bonding technique in accordance with the first preferred embodiment of the present invention.

FIG. 15A is a plan view of an anode substrate having the ring-less getter installed thereon and FIG. 15B is an enlarged cross-sectional view taken along a line X1-X1 of FIG. 15A.

The ring-less getter in this preferred embodiment has a two-layered structure with a getter material layer 821 and an aluminum (Al) layer 831. The getter material layer 821 includes a gas absorbent metal such as Ba and Mg or an alloy thereof such as $BaAl_2$ and MgAl. An additive metal for generating heat of reaction such as Ni, Ti, Fe, Zr, and the like may be added to form the getter material layer 821, if required. The additive metal may not be required, however, if the getter material is flashed by an optical energy, e.g., a laser beam. In case the additive material is omitted, the cost involved may be reduced and the getter can be miniaturized.

The ring-less getter is installed on a thin or a thick aluminum layer 841 formed on the surface of an anode substrate 11 made of an insulation material such as glass or ceramic by using the ultrasonic bonding technique. Herein, it is not needed to weld the whole surface of the aluminum layer 831 but just required to weld two or three spots thereon. The aluminum layer is formed at an area other than the display region A, having a thin or a thick thickness. It is possible to install the aluminum layer 841 during the anode wiring process outside the display region.

If the laser beam is irradiated from the outside of the glass front substrate 12 onto the getter layer 821 of the ring-less getter installed at the anode substrate 11, the getter material layer 821 is evaporated to form a getter mirror film (not shown) at an inside of the front substrate 12. Further, if the laser beam is irradiated to the getter material layer 821 from the outside of glass side plate 13, the mirror film (not shown) is formed at an inside of the side plate 13.

The anode substrate 11, the front substrate 12 and the side plate 13 are all referred to as a substrate.

The ring-less getter is formed by filling a lower layer and an upper layer of a mold with aluminum powder and getter material powder, respectively, and then by performing a press molding process. In this preferred embodiment, the ring-less getter is set to have a diameter of about 1.0 mm and a thickness ranging from about 0.2 to about 1.0 mm. Further, the getter material layer 821 and the aluminum layer 831 respectively has a thickness ranging from about 0.1 to about 0.5 mm. The aluminum layer 841 has a thickness of about 1.2 μm.

The ring-less getter in this first preferred embodiment has a very simple two-layered structure with the getter material layer 821 and the aluminum layer 831. Further, since the ring-less getter can be obtained just by pressing the powder of getter material and aluminum filled in the mold, the manufacturing method is very simple. Further, since the ring-less getter of the present invention has a ring-less structure without any special vessel such as a ring-shaped vessel, the size of the ring-less getter can be reduced. Still further, since the ring-less getter of the present invention can be molded to have any shape that is desired, the ring-less getter can be installed occupying only a small space in the fluorescent display device. Still further, since the aluminum powder of the aluminum layer 831 can be changed to a film shape through the press molding process, it can be used as a backing material for the getter material layer 821 having a comparatively low intensity.

Since the ring-less getter of the present invention is installed by employing the ultrasonic bonding technique, the installation process is simple and, further, unlike in conventional cases where heat-welding is used, impairments of other neighboring components due to the heat can be prevented. In the ultrasonic bonding process, a welding point having a diameter of about 1 mm is formed by applying ultrasonic waves having a frequency of 38 kHz and an output power of 200 W with a pressing force of about 21 N for the duration of about 0.3 second. The welding intensity is about 20 N.

Since the ring-less getter of the present invention serves to form a getter mirror film by using the laser beam unlike in the conventional cases where a high frequency induction heating is employed, impairments of neighboring components due to the heating can be effectively prevented. Further, though the laser beam penetrates the getter material layer 821 when irradiated thereto, the aluminum layer 831 and/or the Al layer 841 beneath the getter material layer 821 reflects the laser beam. Accordingly, even though there is disposed a wiring (not shown) on the anode substrate 11, the laser beam cannot cut the wiring. In case a YAG laser is used in the above-cited laser beam irradiation step, the aluminum layer reflects the laser beam in such a manner that the reflected laser beam has the largest reflectivity at its wavelength of 1.06 μm. For an effective reflection of the laser beam, it is preferable to set the thickness of the aluminum layer to be bout 0.1 mm or greater.

Though the aluminum layer 831 is formed of the aluminum powder in this preferred embodiment, it is possible to use film-shaped or plate-shaped aluminum instead of the aluminum powder.

Figure 16:
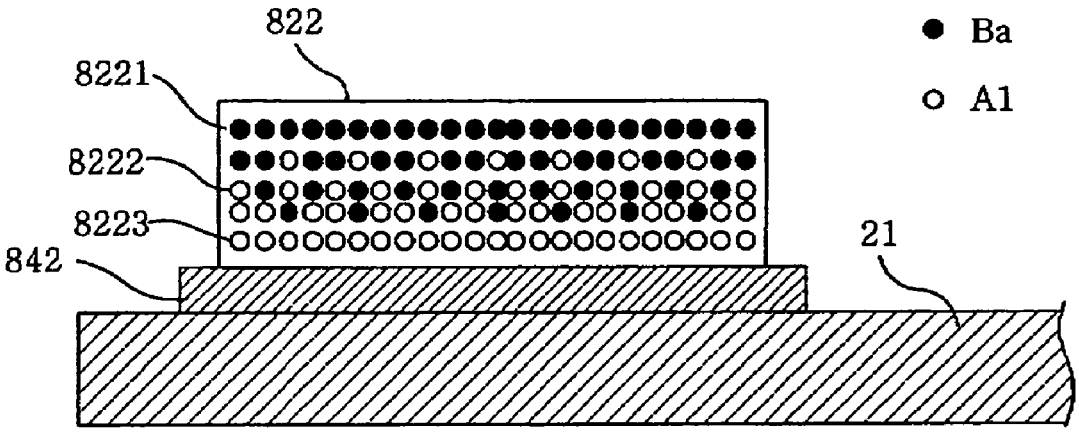
FIG. 16 gives a diagram for use in describing a first structure of a getter material layer shown in the fluorescent display device represented in FIGS. 15A and 15B.

FIG. 16 describes the structure of the getter material layer shown in FIG. 15 in accordance with the first embodiment of the present invention, providing an enlarged view of a part of FIG. 15B.

The ring-less getter 822 is bonded to the aluminum layer 842 formed on the anode substrate 21 by using the ultrasonic bonding technique. The ring-less getter 822 is formed by press-molding the powder of getter material and aluminum. At this time, it is preferable that the aluminum particles and the getter material particles are concentrated at lower parts 8223 and upper parts 8221 of the getter 822, respectively, though it frequently happens that the two types of particles are mixed with each other around middle parts 8222 of the getter 822. Herein, the upper, the middle and the lower parts of the getter 822 are mutually defined according to the relative distance from the aluminum layer 842, the parts being in contact with the aluminum layer 842 referred to as the lower parts of the getter 822. The getter in FIG. 16 thus becomes to have a two-layered ring-less structure with the getter material layer and the aluminum layer. Herein, it is notable that in the process of filling the powder of getter material and aluminum into the mold and in performing the press-molding process to obtain the ring-less getter structured as shown in FIG. 16, careful attention not to allow the getter material particles and the aluminum particles to be mixed with each other is not required anymore, unlike in conventional cases. Accordingly, the ring-less getter molding process becomes easier.

Figure 17A:
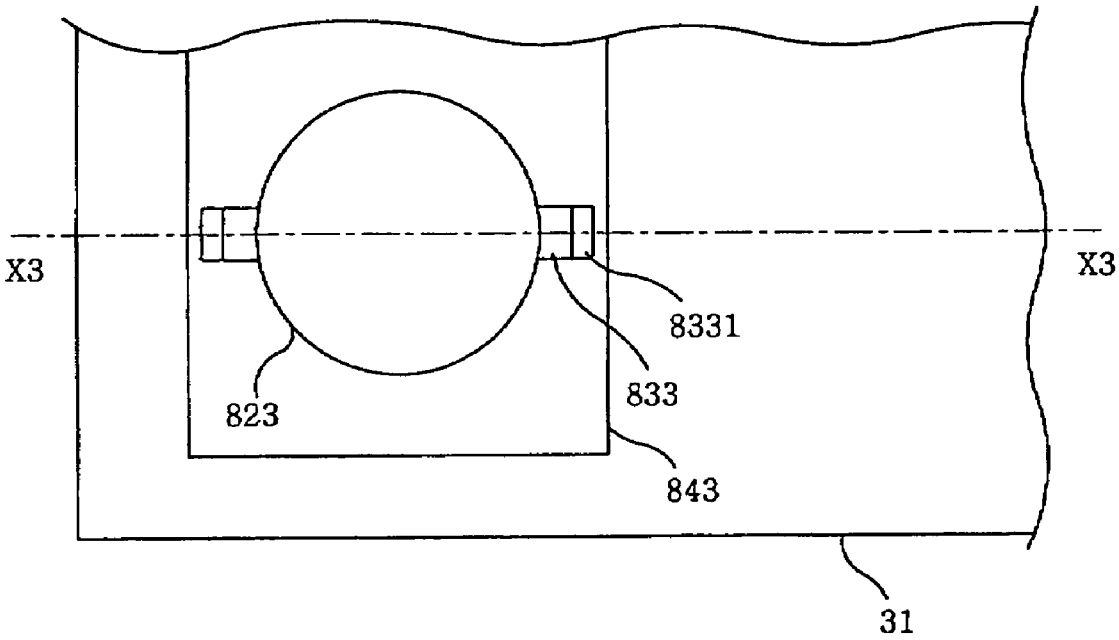
FIGS. 17A and 17B set forth a plan view and a cross sectional diagram, respectively, of a fluorescent display device having a ring-less getter installed therein employing an ultrasonic bonding technique in accordance with the second preferred embodiment of the present invention.
Figure 17B:
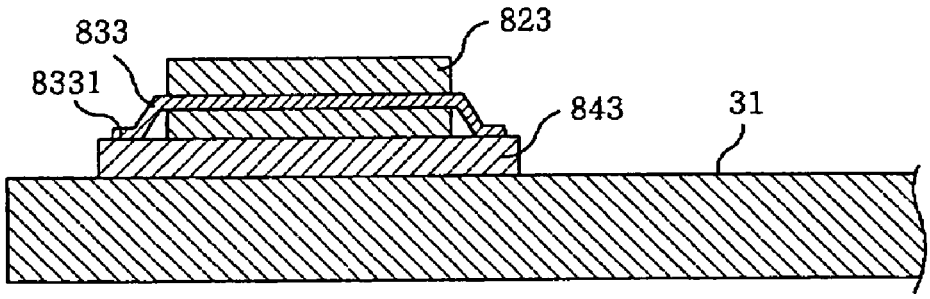

Referring to FIGS. 17A and 17B, there are respectively provided a plan view and a cross-sectional view of a fluorescent display device having a ring-less getter employing an ultrasonic bonding technique in accordance with a second embodiment of the present invention. FIG. 17A is a partial plan view of an anode substrate having a ring-less getter installed thereon and FIG. 17B depicts a cross-sectional view taken along a line X3-X3 of FIG. 17A.

The ring-less getter shown in FIG. 17 includes a getter material layer 823 and an aluminum wire 833. The ring-less getter is formed by filling a press mold with powder of the getter material, installing the aluminum wire at the middle of the getter material powder and then performing the press molding process. The ring-less getter is installed on an aluminum layer 843 formed on an anode substrate 31 by bonding an end portion 8331 of the aluminum wire 833 to the aluminum layer 843 by using the ultrasonic bonding technique. Since it is only required to ultrasonic-bonding the end portion 8331 of the aluminum wire, the getter installation process becomes simple.

Figure 18A:
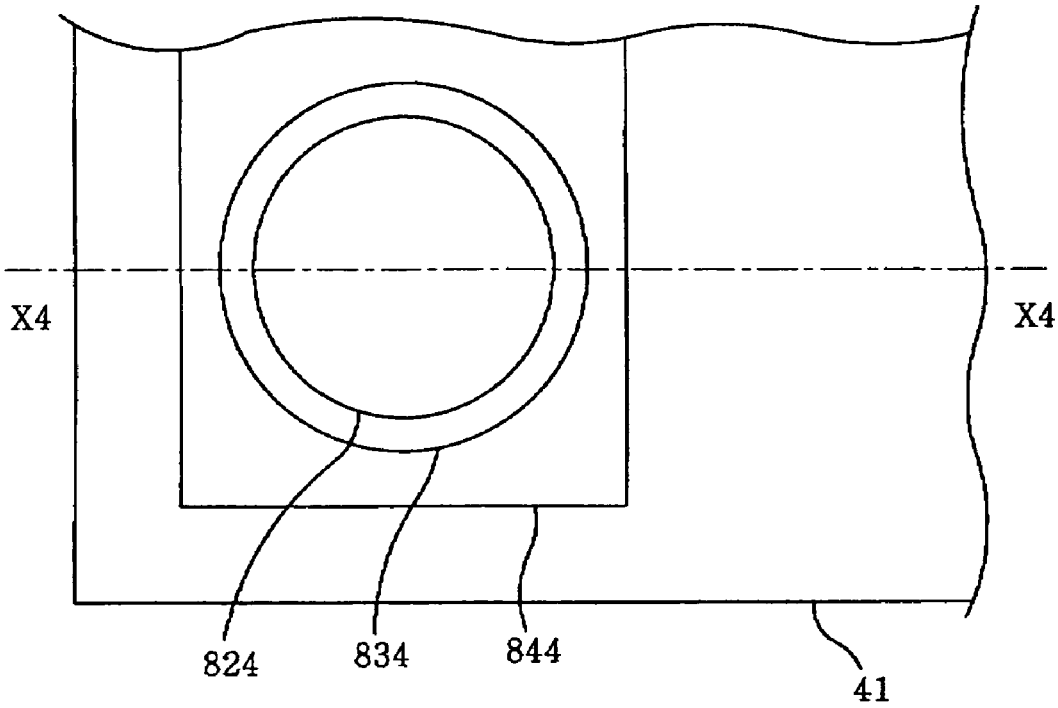
FIGS. 18A and 18B show a plan view and a cross sectional diagram, respectively, of a fluorescent display device having a ring-less getter installed therein employing an ultrasonic bonding technique in accordance with the third preferred embodiment of the present invention.
Figure 18B:
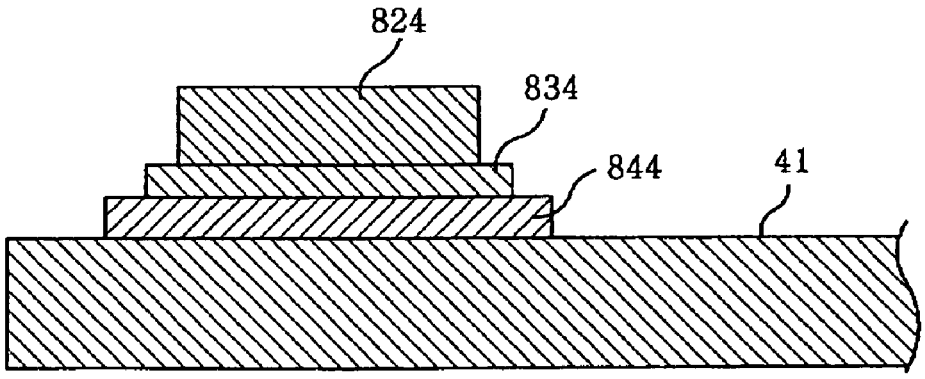

FIGS. 18A and 18B respectively provide a plan view and a cross sectional view of a fluorescent display device having a ring-less getter employing an ultrasonic bonding technique in accordance with a third embodiment of the present invention. FIG. 18A shows a plan view of an anode substrate having the ring-less getter installed thereon and FIG. 18B offers a cross-sectional view of part X4-X4 of FIG. 18A.

The ring-less getter in FIG. 18 includes a getter material layer 824 and an aluminum layer 834 and is formed by filling a press mold with the powder of getter material and aluminum and then by performing a press molding process. The ring-less getter is installed on an aluminum layer 844 formed on an anode substrate 41 by fixing the aluminum layer 834 to the aluminum layer 844 by using the ultrasonic bonding technique. Herein, it is not required to weld the whole surface of the aluminum layer 834 but just needed to weld two or three places thereon.

When a laser beam is radiated to the getter material layer 824, the laser beam (having a larger circumference than that of the getter material layer 824) is eradiated to the aluminum layer 834. Accordingly, the laser beam never cuts a wiring on the anode substrate 41 even if a radiating point of the laser beam goes beyond the periphery of the getter material layer 824.

Though the aluminum layer 834 is made of the aluminum powder in this second preferred embodiment, the aluminum layer 834 can also be formed by using film-shaped or plate-shaped aluminum instead of the aluminum powder.

Figure 19A:
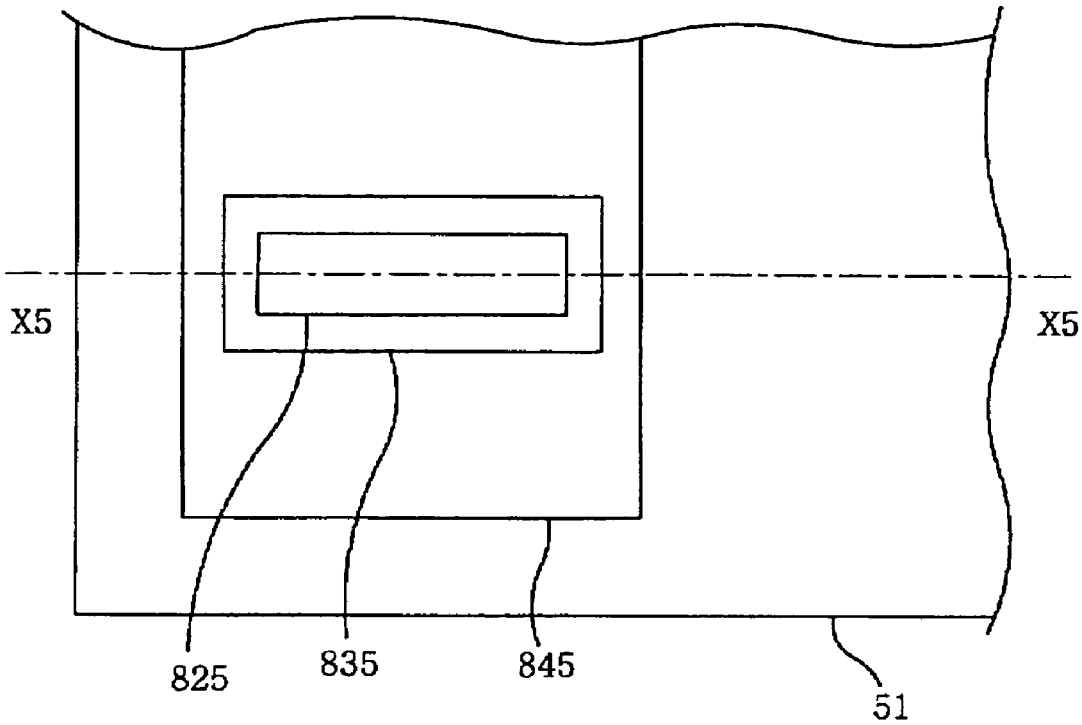
FIGS. 19A and 19B present forth a plan view and a cross sectional diagram, respectively, of a fluorescent display device having a ring-less getter installed therein employing an ultrasonic bonding technique in accordance with the fourth preferred embodiment of the present invention.
Figure 19B:
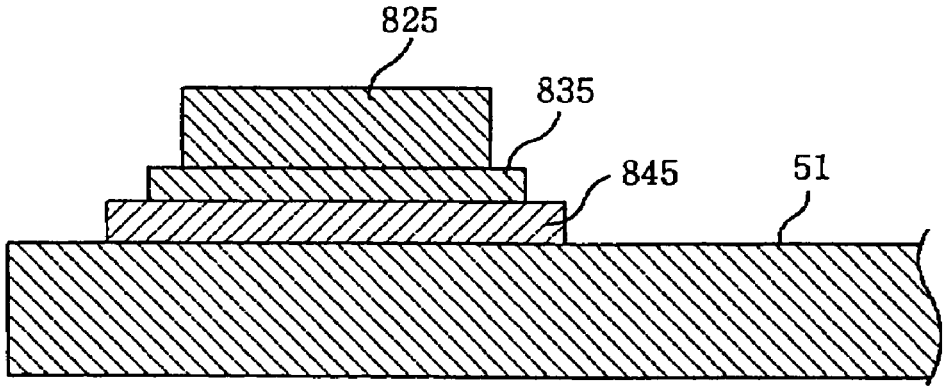
Figure 20A:
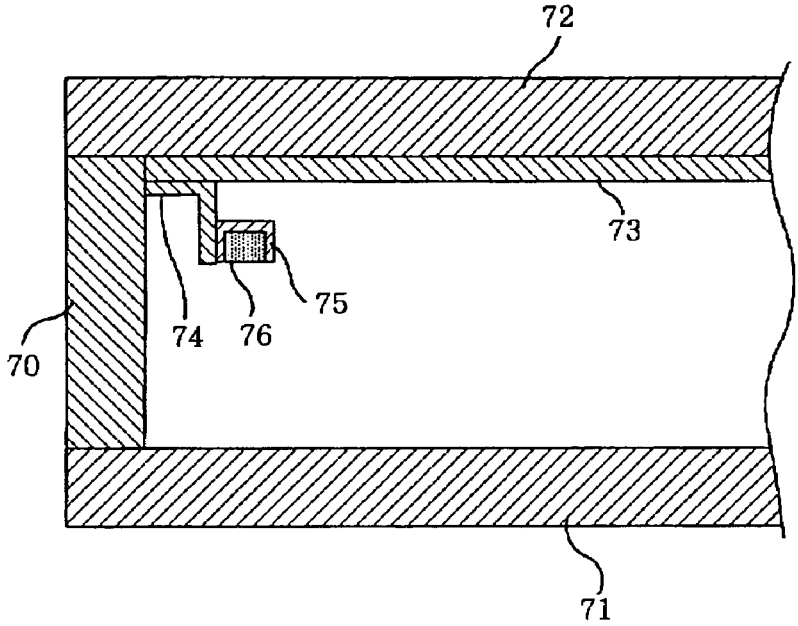
FIG.20A (PRIOR ART)
FIGS. 20A and 20B show respective cross sectional views of a conventional fluorescent display device having a conventional getter attachment unit.
Figure 20B:
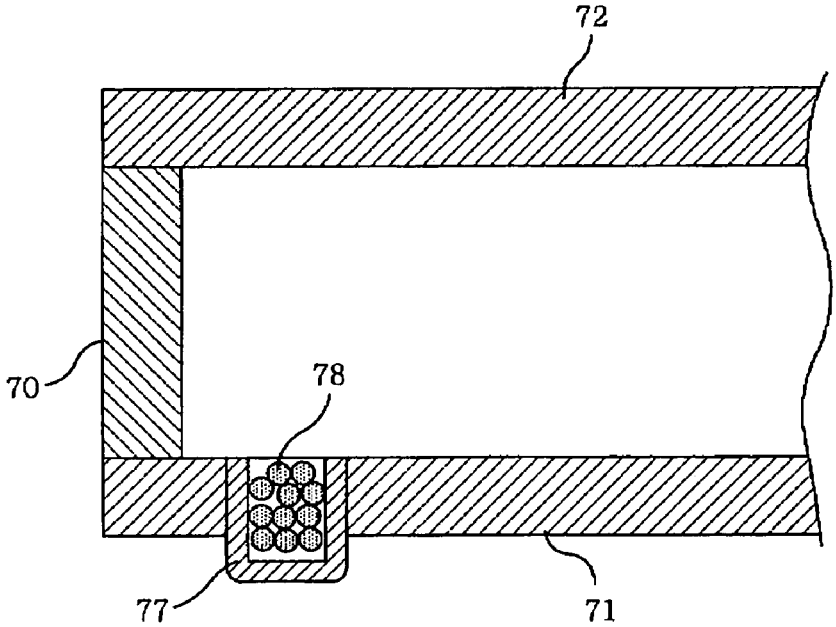
FIG.20B (PRIOR ART)
Figure 21A:
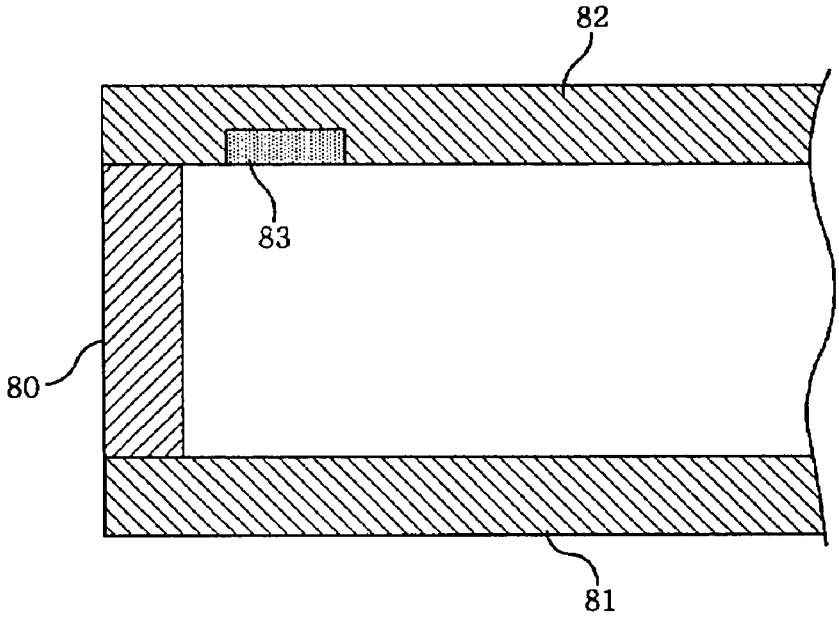
FIG.21A (PRIOR ART)
FIGS. 21A and 21B give respective cross sectional views of a conventional fluorescent display device having another conventional getter attachment unit.
Figure 21B:
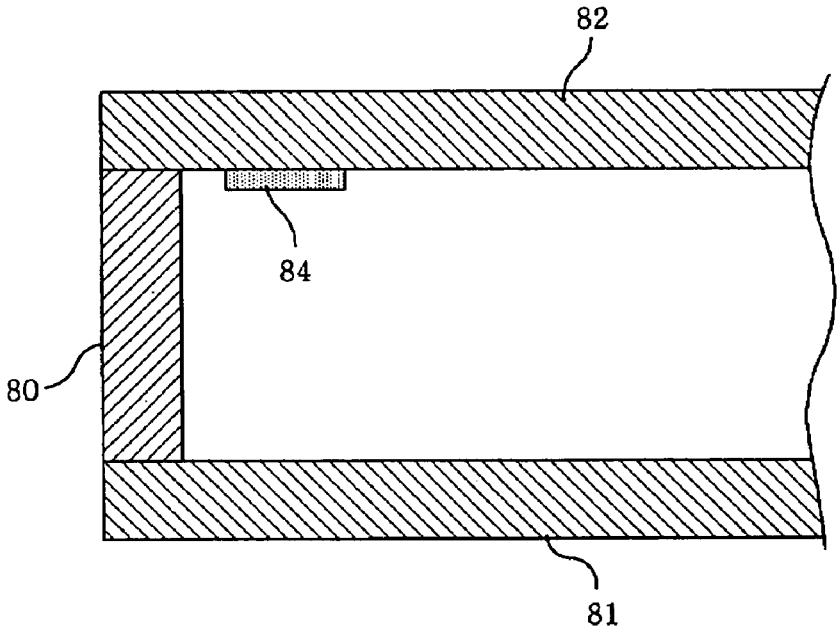
FIG.21B (PRIOR ART)

Referring to FIGS. 19A and 19B, there are respectively provided a plan view and a cross sectional view of a fluorescent display device having a ring-less getter employing an ultrasonic bonding technique in accordance with a fourth embodiment of the present invention. FIG. 19A is a plan view of an anode substrate having a ring-less getter installed thereon and FIG. 19B illustrates a cross-sectional view of part X5-X5 of FIG. 19A.

The ring-less getter shown in FIG. 19 includes a getter material layer 825 and an aluminum layer 835 and is formed by accommodating powder of each of the getter material and the aluminum into a mold and, then, performing a press molding process. The aluminum layer 835 of the ring-less getter 825 is fixed to an aluminum layer 845 on the anode substrate 51 by utilizing the ultrasonic bonding technique. Herein, it is not required to weld the whole surface of the aluminum layer 835 but just required to weld two or three places around the aluminum layer 845 or four corners thereof.

When a laser beam is radiated to the getter material layer 825, the laser beam is eradiated to the aluminum layer 834. Accordingly, the laser beam never cuts a wring on the anode substrate 41 even if a radiating point of the laser beam goes beyond the periphery of the getter material layer 824.

Though the aluminum layer 835 is made of the aluminum powder in this preferred embodiment, film-shaped or plate-shaped aluminum can be used instead of the aluminum powder to form the aluminum layer 835.

FIG. 5 and FIG. 6 illustrate an installation place of the ring-less getter employing the above-described getter installation method with the ultrasonic bonding technique in accordance with the present invention.

The ring-less getter can be installed on the second substrate facing the first substrate as well as on the first substrate.

By using the getter installation method in accordance with the present invention, the getter can be installed at a component as well as on a substrate of the vacuum vessel incorporated in the fluorescent display device.

Though the ring-less getters in accordance with the above-described preferred embodiments are formed by using the press molding process, it is also possible that a getter material film is formed by depositing or screen-printing the getter material on a metal layer (metal plate) of, e.g., aluminum.

Though the ring-less getter in accordance with the above-described preferred embodiments is mounted on the anode substrate, it is also possible to install the ring-less getter on the front substrate and form the getter mirror film on the anode substrate. Further, it is possible to eradiate the laser beam to the ring-less getter installed on the front or the anode substrate through the side plate and form the getter mirror film at an inside of the side plate. Still further, the ring-less getter can also be installed on the side plate. In this case, a getter deposition plate (a getter shield plate) is disposed between the side plate and the display region and the laser beam is eradiated through another side plate so that a getter mirror film is formed on the getter deposition plate. In other words, the ring-less getter of the present invention can be installed at one of the anode substrate, the front substrate and the side plate (all referred to as a substrate) and the getter mirror film can also be formed on the substrate.

Though the ring-less getters include the aluminum layer or the aluminum wire for use in the ultrasonic bonding process and the anode substrate has the aluminum layer installed thereon in the above-described preferred embodiments of the present invention, those wire and layers can be made of nickel, gold, copper, etc. instead of aluminum. Herein, it should be considered that if the getter and the substrate are made of same metal, adhesion force of the getter to the substrate is found to be the largest.

Though the ring-less getters used in the above-described preferred embodiments are volatile, it is also possible to use non-volatile getters. The non-volatile getter has as its major component, for example, Zr, Ti or Ta or an alloy of ZrAl, ZrFe, ZrNi, ZrNbFe, ZrTiFe, ZrVFe or the like. By selectively eradiating a laser beam or an infrared ray to the non-volatile getter until the getter reaches an activation temperature, the non-volatile getter is activated, obtaining a gas absorption feature.

Though the aluminum layers 841 to 845 are formed on a glass substrate in the above-described preferred embodiments, the aluminum layers 841 to 845 can also be formed on a metal component within the fluorescent display device, e.g., on a filament anchor, a filament support, a fixing member for a filament damper, a grid or the like. Further, if the metal component within the fluorescent display device includes aluminum, nickel, gold, copper, and the like, it becomes unnecessary to install separate aluminum layers 841 to 845. In other words, the "metal layer formed on the surface of a base" refers to not only a metal layer separated from the base but also the one integrated with the base.

Though the ring-less getter in the above-described preferred embodiments has a circular shape (or a disc shape), the ring-less getter can have any shape, e.g., an ellipse, a polygon such as a quadrilateral, a ribbon or whatever. The shape, size and thickness of the ring-less getter can be selected by considering the environment around where the ring-less getter or the getter mirror film is to be installed.

Though the vacuum vessel is used in the above-described preferred embodiments of the present invention, an airtight vessel hermetically containing certain gas can be employed instead of the vacuum vessel. In such a case, the getter can be used, for example, to absorb unnecessary gas selectively other than the gas contained in the airtight vessel.

Though the getter is heated and activated by using the laser beam in the above-described preferred embodiments, an infrared ray, a visible ray, an ultraviolet ray or other optical energy can also be used to heat and activate (evaporate) the getter.

Though a separate side plate (side member) is employed in the above-described preferred embodiments, a side member integrated with the front and/or the bottom substrate can be employed. In such a case, it is not required to prepare an additional side plate.

Though the fluorescent display device in the above-described preferred embodiments has a filament functioning as a hot cathode, it is possible to use an electron providing source under an electric field functioning as a cold cathode instead of the hot cathode filament. Further, the fluorescent display device can be alternated with a fluorescent radiation print head (fluorescent radiation device) for performing an optical recording on a photosensitive member. Still further, the present invention can be applied to a fluorescent radiation device (electronic device) of, e.g., a radiation device for a large screen display apparatus, a CRT, a plasma display, etc., besides the fluorescent display device.

In accordance with the preferred embodiments of the present invention, the following effects can be obtained.

Since the getter of the present invention is fabricated in a tablet shape, the getter may be installed without a supporting member and even when the supporting member is needed, an expensive special vessel to accommodate a getter material in the prior art is not needed.

Since the getter of the present invention is fabricated in a tablet shape, the getter of the present invention can be more easily handled in comparison of a getter of a powder or a grain shape in accordance with a prior art.

Since the getter of the present invention is fabricated in a tablet shape, a shape, thickness and a size of the getter can be designed in accordance with an installation place of the getter. Accordingly, there is no limitation of an installation place unlike in the case of the prior art.

Since a shape, thickness and a size of the getter of the present invention can be designed to adapt to an installation place thereof, the dead space which may occur in accommodating the getter can be reduced in comparison with the conventional one.

Since a shape, thickness and a size of the getter of the present invention can be designed to adapt to an installation place thereof, a plurality of getters different from each other in view of shape, thickness and size may be installed in one fluorescent display device. Accordingly, the effect of the getter can be increased.

Since the getter of the present invention may have a certain shape depending on the installation place of the getter, thickness of the getter can be designed in accordance with the installation place thereof. For example, when the getter is installed in a glass substrate, the thickness of the getter is selected to have a value so that there entails no crack by the radiation of a laser beam. Accordingly, a crack which may occur when a laser beam is irradiated on the getter material layer formed by a deposition method can be avoided.

Since the getter of the present invention is formed with only getter material, a mixture other than the getter material is not evaporated while in the prior art, a mixture is evaporated and entails a problem when the getter material layer is formed by employing a paste coating technique.

In manufacturing a fluorescent display device in accordance with preferred embodiments of the present invention, a getter may be previously installed in a component, e.g., a grid or a substrate or be installed at a stage of assembling the fluorescent display device. Accordingly, the installation of the getter can be performed in an appropriate stage in accordance with the structure of the fluorescent display device.

Since the getter is a ring-less getter in the preferred embodiments of the present invention, the getter material is not accommodated in an accommodation vessel. Accordingly, the getter itself can be directly installed in a vacuum vessel. Therefore, the fabrication of a getter accommodation vessel is not needed and a unit used in installing the getter accommodation vessel is not necessary. As a result, the fabrication cost decreases and installation becomes easy.

The installation of the getter can be carried out by hanging a metal wire on a getter and then welding the metal wire on the metal layer or welding a metal line on the metal layer installed on the getter. Accordingly, the installation of the getter becomes easy. In the present invention, a baking process is not necessary contrary to the prior art case, wherein the baking process is necessary to fit the getter with adhesive material such as a frit glass. As a result, in the present invention, the deterioration of the effect of the getter is prevented in the baking process due to the oxidation of the getter.

Since an adhesive material such as a frit glass is not used in the preferred embodiments of the present invention, there entails no gas deterioration of the function thereof during baking process of the fluorescent display device or evaporation of the getter. Further, since the getter is fixed by employing a metal wire such as an Al wire, it is possible to fix the getter more tightly without considering the thermal expansion coefficient of a corresponding supporting member or a mounting member.

Since the getter in the preferred embodiments of the present invention can be installed without the necessity of an additional supporting member, the space needed to install the getter can be decreased. Further, since the getter may be formed in a certain shape, size and thickness in accordance with the installation places of the getter, the space in a vacuum vessel can be effectively utilized.

In the present invention, a getter film can be formed on a substrate having a getter formed thereon when a metal line such as an Al line is installed on the getter and the metal line is arranged in the substrate side. In this case, there entails no fly of an evaporated getter in a component installed between the substrate and another substrate facing the substrate.

When the getter is installed so that the metal line is parallel to a display region, the getter can be installed near to the display region since evaporated particles of the getter do not fly toward the display region. When the getter is evaporated, a laser beam can be irradiated from a first substrate facing to a second substrate having a getter installed thereon onto the getter, thereby forming getter films on the first and second substrate. Accordingly, getter films can be formed at two places by employing one getter; the getter film is effectively formed; an area of the getter film is increased; and the effect of the getter is enhanced.

In the present invention, when a metal line, e.g., an Al line for installation of the getter is fitted to a metal film/layer, e.g., an Al film/layer by employing an ultrasonic welding technique, the metal line can be welded to the metal film/layer without applying a damage on the metal film/layer even if the metal film/layer is a thin film.

A ring-less getter of the present invention is made of two layers, e.g., a getter material layer/plate and an Al layer or a getter material layer and an Al wire without employing a special vessel such as a ring-shaped vessel. Therefore, the ring-less getter of the present invention becomes simple and small. Accordingly, the ring-less getter of the present invention has small accommodation space and can be manufactured at a lower price. Since the ring-less getter of the present invention can be manufactured by employing an ultrasonic bonding technique, installation thereof becomes simple and there entails no problem to give damage to other component due to heat produced in installation process.

The metal layer such as an Al layer of the ring-less getter of the present invention serves as a reinforcing member for the getter material layer having a relatively weak strength.

In the preferred embodiments of the present invention, since the ring-less getter of the present invention serves to form a getter mirror film by using a laser beam, it is not required to heat the other component in contrast to conventional cases where high frequency induction heating is used. Further, since the metal layer, e.g., an Al layer, of the ring-less getter of the present invention reflects a laser beam, when a getter mirror film is formed by the laser beam, the laser beam does not cut a wiring formed in an anode substrate even if the laser beam passes through the getter material layer.

While the present invention has been described with respect to certain preferred embodiments only, other modifications and variations may be made without departing from the scope of the present invention as set forth in the following claims.

What is claimed is:

1. An electron tube having one or more ring-less getters of a tablet shape formed by fabricating a getter material, wherein the one or more ring-less getters having opposite first and second surfaces are mounted in a vessel of the electron tube without using containers and a light is irradiated on a first surface of the one or more ring-less getters to thereby activate the one or more ring-less getters, wherein the one or more ring-less getters are volatile and getter films are formed in the vessel by irradiating the light onto the one or more ring-less getters in order to evaporate the one or more ring-less getters, wherein the vessel includes a front substrate and a back substrate facing the front substrate, the front substrate being assembled to face the back substrate with a side plate therebetween, and wherein each of the one or more ring-less getters is attached to the front substrate or the back substrate by an intermediate adhesive layer having a same shape as a respective one of said ring-less getters and extending between said second surface and the front or back substrate, said respective one of said ring-less getters thereby being attached to said front or back substrate without using a supporting member other than said intermediate adhesive layer.

2. The electron tube of claim 1, wherein a space between the front substrate and the back substrate is equal to or smaller than 1.4 mm.

3. The electron tube of claim 1, wherein the one or more ring-less getters are installed between the side plate and a supporting member supporting a filament and wherein the getter films are formed on the side plate and the front or the back substrate.

4. The electron tube of claim 3, wherein the number of the one or more ring-less getters is greater than 1.

5. The electron tube of claim 1, wherein, when mounting the one or more ring-less getters in a vessel of the electron tube, the thickness of the one or more ring-less getters ranges from about 100 μm to several hundreds of μm.

6. The electron tube of claim 1, wherein the getter material includes Ba.

7. The electron tube of claim 1, wherein the one or more ring-less getters are installed on the front substrate or the back substrate between the side plate and a display region.

8. The electron tube of claim 7, wherein the number of the one or more ring-less getters is greater than 1.

9. The electron tube of claim 1, wherein a space between the front substrate and the back substrate is equal to or smaller than 2 mm.

10. The electron tube of claim 1, wherein a material forming the intermediate layer is prevented from being disposed on an evaporation surface of each of the one or more ring-less getters.

11. The electron tube of claim 10, wherein the material is selected from the group consisting of a frit glass, indium, tin, indium alloy and tin alloy.

12. The electron tube of claim 11, wherein each of the one or more ring-less getters has a surface parallel to the front substrate or the back substrate and the surface is attached to the front substrate or the back substrate.

13. The electron tube of claim 1, wherein the one or more ring-less getters are installed in a non-display region which is not related with a display region on the front substrate or the back substrate.

14. The electron tube of claim 1, wherein a lower surface of the intermediate layer is adhered to one of the front substrate or the back substrate, and the one or more ring-less getters are adhered to an upper surface of the intermediate layer.

* * * * *